United States Patent [19]

Watanabe et al.

[11] Patent Number: 4,789,444

[45] Date of Patent: Dec. 6, 1988

[54] PROCESS FOR ELECTROLYTICALLY PRODUCING METALS OF NI, CO, ZN, CU, MN, AND CR FROM A SOLUTION THEREOF

[75] Inventors: Morio Watanabe, Hyogo; Sanji Nishimura; Nobuatsu Watanabe, both of Kyoto, all of Japan

[73] Assignee: Solex Research Corporation of Japan, Tokyo, Japan

[21] Appl. No.: 14,260

[22] Filed: Feb. 12, 1987

[30] Foreign Application Priority Data

Feb. 15, 1986 [JP] Japan ..... 61-31544

[51] Int. Cl.[4] ..... C25C 1/12

[52] U.S. Cl. ..... 204/107; 204/106; 204/108; 204/112; 204/113; 204/114; 204/118; 204/105 M; 204/105 R; 423/139

[58] Field of Search ..... 204/106–108, 204/112–113, 114, 118, 105 R, 105 M; 423/139

[56] References Cited

U.S. PATENT DOCUMENTS

| | | | |
|---|---|---|---|
| 4,082,832 | 4/1978 | Watanabe et al. | 423/70 |
| 4,113,588 | 9/1978 | Watanabe et al. | 204/151 |
| 4,434,002 | 2/1984 | Watanabe et al. | 75/0.5 AA |
| 4,497,655 | 2/1985 | Watanabe et al. | 423/139 |

FOREIGN PATENT DOCUMENTS

| | | |
|---|---|---|
| 34-9251 | 10/1959 | Japan . |
| 37-17114 | 10/1962 | Japan . |
| 39-28013 | 12/1964 | Japan . |
| 41-10087 | 5/1966 | Japan . |
| 42-23801 | 11/1967 | Japan . |
| 44-23747 | 10/1969 | Japan . |
| 56-5827 | 2/1981 | Japan . |
| 56-12320 | 3/1981 | Japan . |
| 58-5989 | 2/1983 | Japan . |
| 58-12323 | 3/1983 | Japan . |
| 60-387 | 5/1983 | Japan . |
| 59-10923 | 3/1984 | Japan . |
| 59-43537 | 10/1984 | Japan . |
| 60-2248 | 1/1985 | Japan . |
| 60-4135 | 2/1985 | Japan . |
| 60-10761 | 3/1985 | Japan . |
| 61-34484 | 8/1986 | Japan . |

*Primary Examiner*—R. L. Andrews

*Attorney, Agent, or Firm*—Jules E. Goldberg

[57] ABSTRACT

Process for electrolytically producing metals of Ni, Co, Zn, Cu, Mn, and Cr, comprising, electrolyzing an aqueous solution containing ions of a metal as main component selected from Ni, Co, Zn, Cu, Mn, and Cr in a cathode compartment to deposit the metal electrolytically on a cathode, the cathode compartment being separated by one or more diaphragms from the remainder of the solution where iron or a metal containing iron is used for material of corrosible anode, and maintaining the concentration of iron ion in the solution circulating in the anode compartment at a low level by bringing the whole or a part of the circulating solution into contact with an organic solvent which is prepared by adding petroleum hydrocarbon for dilution of one or more extracting agents selected from the group consisting of carboxylic acids, alkylaryl phosphoric acids, hydroxyoximes, alkyl phosphoric acids, alkylamines, ketones, alkylamides, and neutral phosphoric acid esters, to extract and remove the iron or the chloro-complex ions.

5 Claims, 9 Drawing Sheets

PROCESS FOR ELECTROLYTICALLY PRODUCING METALS OF NI, CO, ZN, CU, MN, AND CR FROM A SOLUTION THEREOF

BACKGROUND OF THE INVENTION

1. Field of the Invention

The present invention relates to the electrolytic production of metals of Ni, Co, Zn, Cu, Mn, and Cr using an insoluble anode.

2. Description of the Prior Art

Previously, electrolytic production of these metals (including Ni, Co, Zn, Cu, Mn, and Cr) has been carried out as described below.

Electrolytic Production of Nickel

Recently the solvent extraction technique is utilized in a variety of fields and the electrolytic production technique combined with the use of an insoluble anode is employed when a solution of nickel sulfate or a nickel chloride bath is used.

When a sulfuric acid bath is used, a stainless steel plate serves as anode and a pH and a concentration of nickel are selected as not to dissolve the anode. In a chloride bath, the anode is prepared from carbon, metallic titanium, or metallic titanium with the surface lined by a noble metal such as platinum.

In either case, a gas is evolved at the anode as shown by the following equations: anode reactions; in a sulfuric acid bath:

$$H_2O \rightarrow \tfrac{1}{2}O_2 \uparrow + 2H^+ + 2e^- \quad (1)$$

in a chloride bath:

$$2HCl \rightarrow Cl_2 \uparrow + 2H^+ + 2e^- \quad (2)$$

The bath voltage differs with the difference in material and structure of the anode, as well as by the increase of voltage due to the oxygen overvoltage and the evolution of gases.

Previously, however, soluble anodes were more popularly employed to avoid the disadvantages of insoluble anodes. The typical one is the process realized in industry by Le Nickel Co. of France in which an oxide material molded under pressure and reduced by carbon monoxide serves as anode and the other is Hybinette process for the electrolytic smelting in which an oxide is reduced and melted in an electric furnace and the melt is shaped in a mold into an anode piece. In this method, the anode is formed of crude nickel which requires a long time of operation in treating a nickel matte containing less iron by oxidation and baking to reduce into crude nickel. Further an additional troublesome treatment is necessary in which the iron in the waste anolyte is oxidized with air or chlorine into a precipitate of iron (III) hydroxide and the precipitate is separated by filtration.

An improvement of the crude nickel anode is the nickel matte which is used for anode without any treatment. In this method, the anode is liable partly to turn into passive state on account of a high content of sulfur. Consequently, a high voltage is necessary for the electrolysis, the pH of the anolyte becomes lower and therefore a larger amount of nickel carbonate is required for removing the iron content by neutralization and precipitation. To overcome a number of defects as mentioned, inventions such as Japanese Patent Publications No. Sho 34-9251 and No. Sho 39-28013 were proposed. Japanese Patent Publication No. Sho 44-23747 employs anion exchange resins for the removal of contamination of iron. Special anodes are used in Japanese Patent Publications No. Sho 41-10087 and No. Sho 42-23801.

Electrolytic Production of Cobalt

The electrolytic smelting of cobalt using a soluble anode (crude cobalt or cobalt matte for anode) has been so far employed as it has with nickel. Improvement of conditions in the electrolysis was made in Japanese Patent Publication No. Sho 37-17114.

In recent years the solvent extraction method has found its way in industrial processes. In this connection, the electrolytic production of metals using a soluble electrode are adopted in either of a sulfuric acid and a chloride bath. Use of a soluble electrode involves some difficulties, that is evolution of gas according to Equation 1 for a sulfuric acid bath and Equation 2 for a chloride bath, both of which lead to an elevated voltage of electrolysis.

Electrolytic Production of Zinc

In the electrolytic smelting of zinc, the electrolytic solution of zinc is prepared from an oxide by leaching it with sulfuric acid, adjusting the pH of the solution followed by an oxidizing treatment to purify the solution, or by extracting zinc with a solvent followed by the reversed extraction with an electrolytic solution which is supplied to the electrolysis vessel. In either case, an insoluble anode is employed. The anode is an insoluble metallic electrode of which lead is the main constituent. In this case, oxygen gas is evolved at the anode surface according to Equation 1, which prevents to lower the voltage necessary for the electrolysis.

Electrolytic Production of Copper

Most electrolytic smelting of copper employs a soluble anode prepared from crude copper. Copper ions dissolve at the anode and metallic copper deposits at the cathode according to the following equations:

$$Cu^0 \rightarrow Cu^{2+} + 2e^- \text{ at the anode and}$$
$$Cu^{2+} + 2e^- \rightarrow Cu^0 \text{ at the cathode.}$$

Impurities in the crude copper can be removed continuously by controlling the pH of the electrolytic exhaust solution and reducing with hydrogen sulfide. Some limitations exist for the material to produce the soluble anode.

In case copper is produced from oxide ores or low content ores or recovered from industrial exhausts, an electrolytic production process using an insoluble anode may be applied in combination with the solvent extraction method. In this case, however, oxygen gas is evolved according to Equation 1 and, as a result thereof, the electrolysis voltage is elevated and the electrolysis requires 5–7 times as much electrical energy as that when a soluble anode is employed.

Electrolytic Production of Manganese

In a most common process, manganese metal is produced by an electrolysis with an insoluble anode of a solution containing $Mn^{2+}$ ions prepared by dissolving manganese carbonate and manganese monoxide in sulfuric acid and purified. The insoluble anode employed is a metallic anode which is made from lead as main constituent containing Sn or Ag. In the cathode compartment where a polarization potential is given rise to by the reaction, $Mn^{2+}+e^- \rightarrow Mn^0$, the pH assumes a high value and the anode potential becomes as low as about −1.2 V. On the other hand, in the anode compartment oxygen is evolved according to Equation 1 at the surface of the anode owing to the insolubility of the electrode and the potential of the anode becomes as high as about +1.1 V, which leads to a higher voltage for the electrolysis. In addition, a reaction of oxidizing $Mn^{2+}$ to $Mn^{4+}$ occurs at the anode which further brings about additional defect to lower the efficiency in electrolysis.

Electrolytic Production of Chromium

Most electrolytic processes for the production of chromium employ an insoluble anode, where chromium ores or ferrochromium is dissolved in sulfuric acid, the solution is cooled to deposit crude crystals of mixed sulfates of chromium and iron, the crystals are redissolved and ammonium sulfate and ammonia are added to the solution from which iron is separated by deposition in the form of ammonium iron (II) sulfate and chromium in the form of chromium alum crystals. The chromium alum is dissolved in water or the electrolytic solution and the resulting solution of chromium (III) sulfate is supplied to the cathode compartment of the electrolysis. Although chromium metal can be produced from a solution containing chromium (VI) by electrolysis in an alternative process, the process is seldom employed in industry except for plating because of the economical disadvantage. A process is proposed for preparing an electrolysis solution in Japanese Patent Publication No. Sho 35-3210, but no difference is found from previous ones in the process of electrolytic smelting of chromium.

In previous processes where an insoluble anode is used (prepared from a metal of which lead is the main constituent or from carbon), oxygen gas is evolved according to Equation 1 on the surface of the anode and a part of chromium (III) is turned into chromium (VI), not only leading to the elevated anode potential up to +1.5 V but also lowering of the current efficiency. Further, the remarkable oxidation in the anode compartment may bring about distortion, breakage and local outbreak of passive state. A demerit therefrom is an elevated voltage necessary for the electrolysis.

SUMMARY OF THE INVENTION

The object of the present invention is to provide a process for the electrolytic production of metals of Ni, Co, Zn, Cu, Mn, and Cr which employs an insoluble anode to avoid the increase of the electrolysis voltage across the electrolysis tank and give solutions to the above-mentioned troubles.

The present invention utilizes a series of inventions which present inventors have already disclosed, they include a process for separating manganese from an aqueous solution (Japanese Patent No. 1279875), a process for fractionally recovering mixed exhaust acids (Japanese Patent No. 1235995), a process for recovering used sulfuric acid (Japanese Patent No. 1068784), a process for recovering an acid containing iron by use of an organic solvent (Japanese Patent No. 1174401), a process for the recovery of exhaust hydrochloric acid (Japanese Patent No. 1064109), a process for managing a solution containing fluorine and ammonium ion (Japanese Patent Application No. Sho 57-225813), a process for manufacturing metallic iron (Japanese Patent Application No. Sho 55-119308), a process for manufacturing hydrous oxide of iron (Japanese Patent Publication No. Sho 60-387), a process for stripping iron ions (Japanese Patent No. 1278025), a device for crystal deposition (Japanese Patent Publication No. Sho 60-10761), and a process for producing oxide of iron (Japanese Patent Publication No. Sho 60-4135), and this invention has been completed during the investigations to convert iron ions in an aqueous solution into iron or iron oxide powders of high purity.

In principle, the present invention intends to provide a process for electrolytically producing metals without increasing the concentration of iron ions in a solution circulating in the anode compartment by using iron alone or an alloy or mixture of iron with other metal(s) as a soluble anode.

The present invention will be explained into further details by referring to the attached drawings.

DETAILED DESCRIPTION OF THE INVENTION

Figure 1:
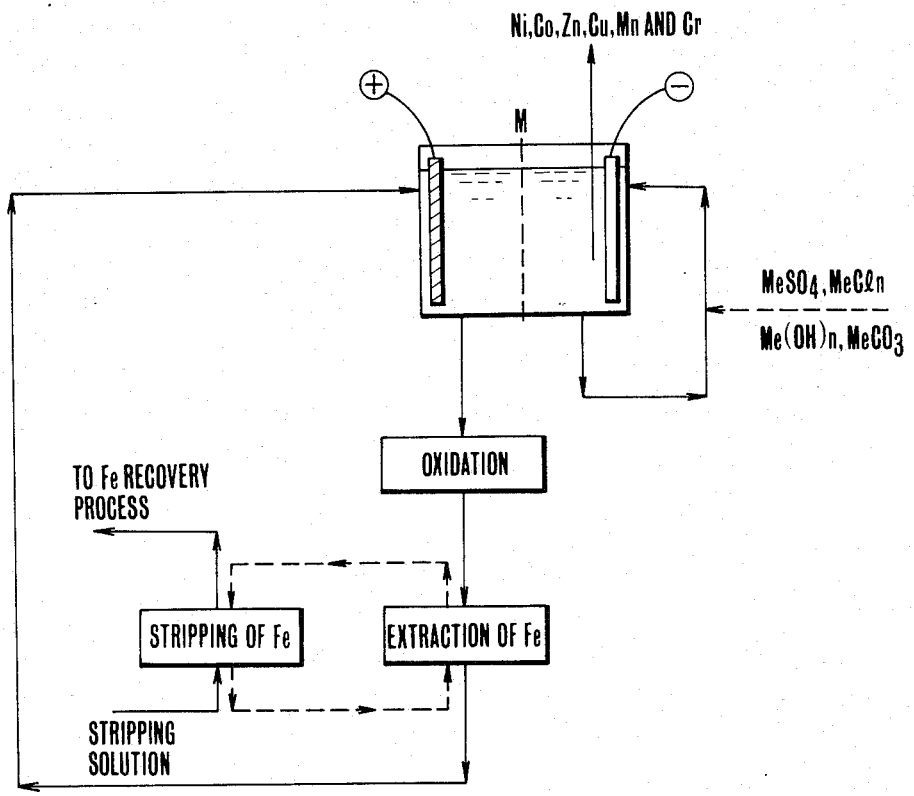
FIG. 1 shows the basic process of the present invention. An iron anode is used from which dissolved iron ions are removed by extraction to control the concentration of iron in the anode compartment so that the equilibrium is not established with the potential. Thus, the voltage necessary for the electrolysis can be lowered.

The basic structure is shown in FIG. 1. In the anode compartment is suspended a soluble anode composed of iron alone or with other metal(s) (in the shape of a plate, or permittedly a round or square basket) and in the cathode compartment which is separated by a diaphragm from the remainder of the electrolytic solution is suspended a stainless steel plate usually employed in an electrolytic production of metals, a seeding plate prepared from the object metal, or an aluminum plate. It is necessary during electrolysis to prevent the iron and other impurity ions in the anode compartment from migrating to the cathode compartment by increasing the amount of the circulating solution in the anode compartment. Further, the circulating solution should frequently transferred to an iron extraction operation stage to diminish the concentration of iron to such a level as not to effect the cathode compartment. Furthermore, use of an anion exchange resin membrane, as well as a porous diaphragm, is recommended to shut the cathode compartment from iron and other undesired metal ions. As an electrolysis progresses and the concentration of iron ions in the anode compartment is increased, a fraction or the whole of the circulating solution in the anode compartment should be pulled out and oxidized, if necessary, to convert iron (II) ions into iron (III) ions, and then the iron (III) ions should be extracted by bringing the circulating solution into contact with an organic solvent which is prepared by adding petroleum hydrocarbon for dilution of one or more extracting agents selected from the group consisting of carboxylic acids, alkylaryl phosphoric acids, hydroxyoximes, alkyl phosphoric acids, alkylamines, ketones, alkylamides, and neutral phosphoric acid esters, and the circulating solution from which the iron ions have been removed is transferred to the anode compartment. The organic solvent employed for extracting iron ions can be regenerated as follows. $Fe^{3+}$ ions are removed from the organic solvent and transferred to an aqueous phase by the contact with an aqueous solution containing HF and $NH_4^+$. On the other hand, $Fe^{2+}$ ions are transferred from the organic to an aqueous phase by the contact with an aqueous solution (containing $SO_4^{2-}$, $NO_3^-$, $Cl^-$ and $F^-$) of a pH not more than 4. Chloroiron complex ions such as $FeCl_4^-$ and $FECl_3^-$) are removed by bringing the organic solvent into contact with water or an aqueous solution of a pH not less than 1 to regenerate the organic solvent. The iron ions transferred to the aqueous phase can be recovered as metallic iron or iron oxide by a number of processes which the present inventors have already disclosed.

Figure 2:
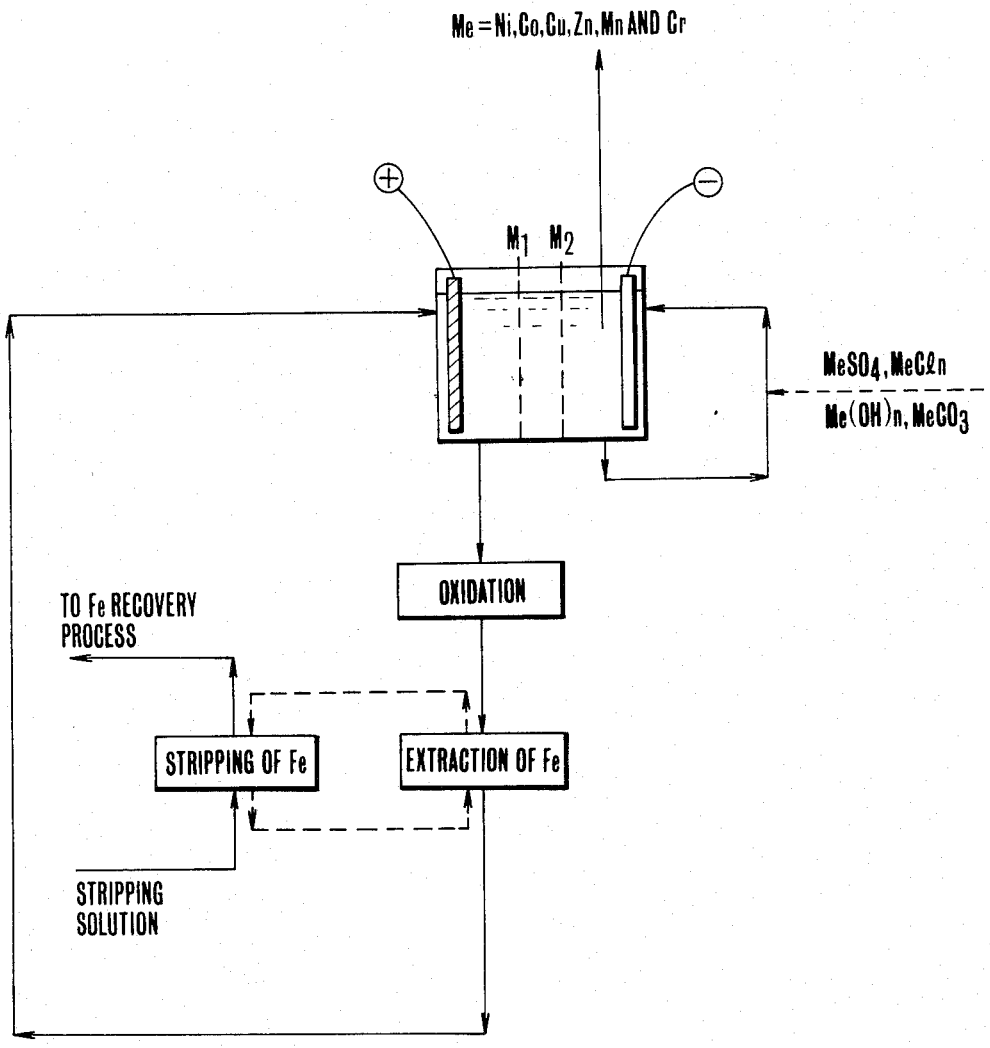
FIG. 2 is also a process diagram, but the electrolysis tank is divided into three compartments by two diaphragms. This arrangement is particularly useful when a high pH is required for the circulating solution in the cathode compartment. The iron ions dissolved in the anode compartment may be hydrolyzed on the surface of diaphragm. This trouble can be reduced by increasing the number of compartments.

In FIG. 2, an intermediate compartment is provided between the cathode and anode compartments. When pH of the catholyte is between 8–8.5 and the anolyte is acidic, an intermediate compartment in which a solution circulates is necessary to avoid a precipitate of iron hydroxide from being formed on account of too large a difference of the $H^+$ion concentration between cathode and anode compartments. There exist in the cathode compartment such anions as boric, acetic and citric acids anions to control the behavior of metals to be deposited by electrolysis. For these anions not to move into the anode compartment, a cation exchange membrane is installed between the cathode and the intermediate compartments as a diaphragm. On the other hand, an anion exchange membrane as diaphragm is set between the anode and the intermediate compartments so that impurity ions including iron ions do not move into the cathode compartment. Anything else is the same as in FIG. 1.

Figure 3:
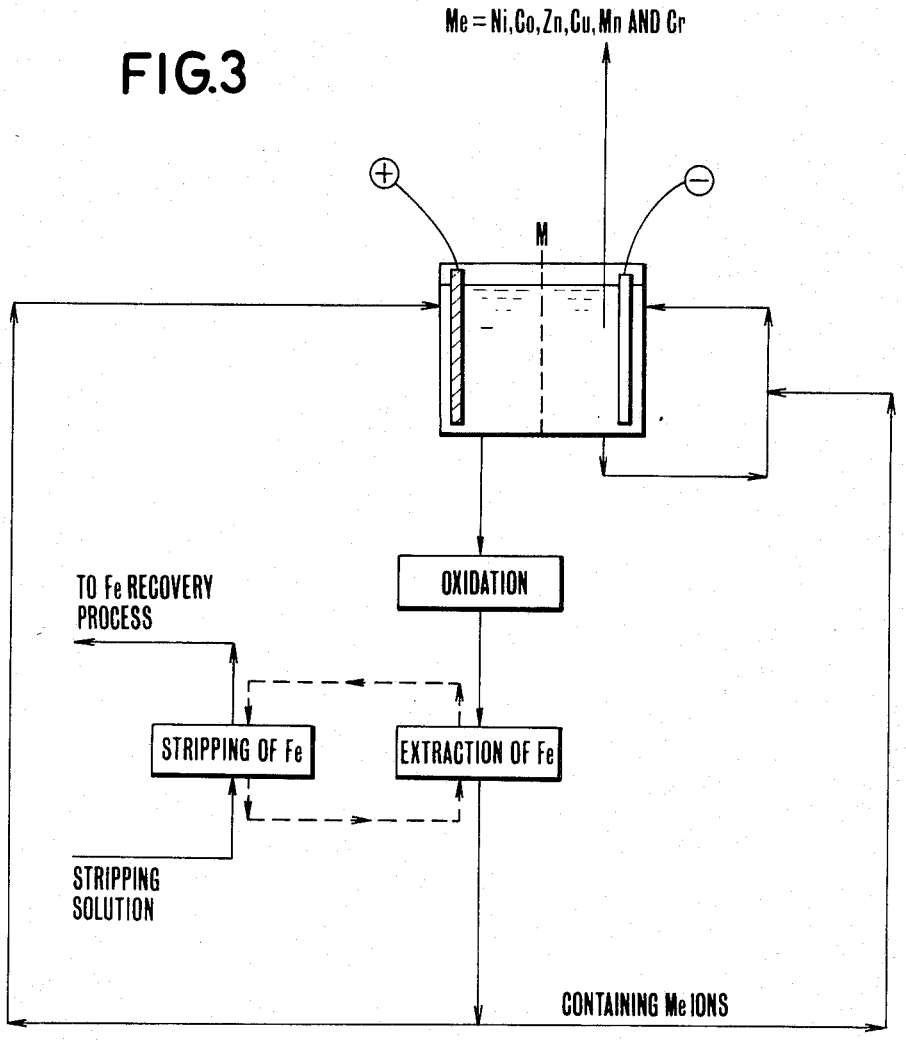
FIG. 3 shows the process which is favorably employed when the anode is made from an alloy or a mixture of iron with the object metal, where the concentration of the latter metal is large after the iron has been removed.

FIG. 3 shows the case where the anode material is composed of an alloy or a mixture of iron and the metal which is aimed to be obtained. When the anolyte is treated to remove iron, the metal ion is concentrated to a relatively high level in the anolyte and therefore a fraction of the solution is circulated into the cathode compartment.

Figure 4:
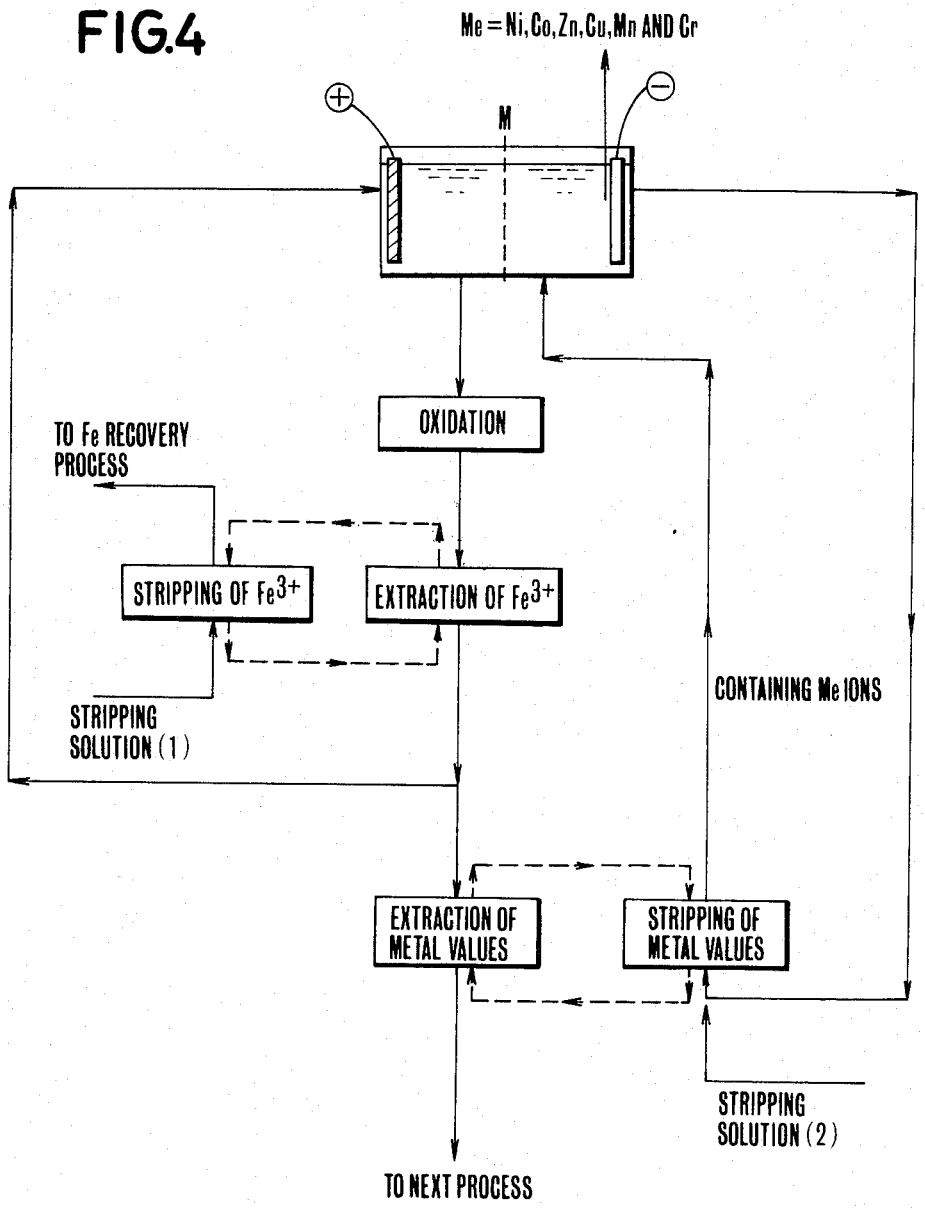
FIG. 4 shows the process in which the same kind of anode material as in FIG. 3 is employed, but the concentration of the object metal is low after the iron has been removed. A solution which strips the object metal is introduced to the cathode compartment according to the basic process.

FIG. 4 shows the situation where the concentration of the object metal remains at a low level even after the treatment to remove iron has been made. A fraction or the whole of the solution from which iron has been removed is first treated to adjust the $H^+$ ion concentration, and is brought into contact with an organic solvent which is prepared by adding petroleum hydrocarbon for dilution of one or more extracting agents selected from the group consisting of carboxylic acids, alkylaryl phosphoric acids, hydroxyoximes, alkyl phosphoric acids, alkylamines, ketones, alkylamides, and neutral phosphoric acid esters, to extract an object metal ions selected from Ni, Co, Zn, Cu, Mn, and Cr ions, and then by making contact of the organic solvent with the circulating stripping solution (2) containing sulfuric and hydrochloric acids to transfer the metal ions into the stripping solution which then is lead to the cathode compartment.

Figure 5:
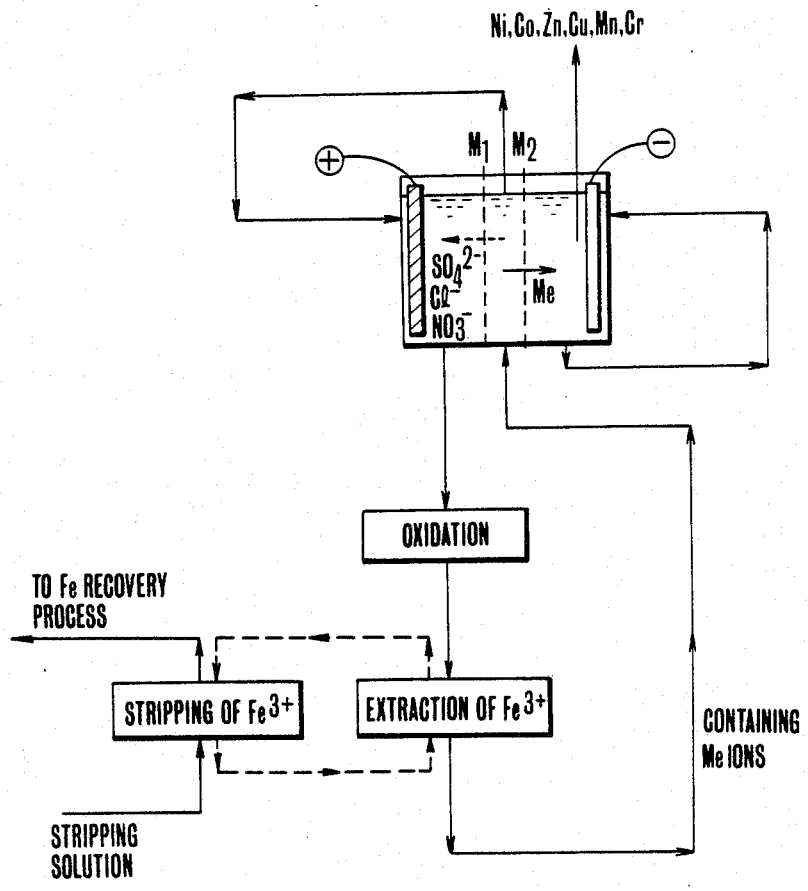
FIG. 5 is a diagram for the process which is adopted when the same anode material as in FIG. 3 is employed. In this scheme, the solution, after the iron removal treatment, is not introduced directly to the cathode compartment but to the intermediate compartment from which the object metal ions are supplied indirectly through the diaphragm. This is the case when a high pH is required for extracting object metal ions. Addition of alkali is necessary to elevate pH, but this process dispenses with the alkali without leading to loss of the anode solution.

In FIG. 5 shows the same anode as in FIG. 3. The anolyte, after treated for removing iron, is introduced to the intermediate compartment. From the intermediate compartment, the object metal aimed at is supplied through the diaphragm to the cathode compartment where the metal ions are extracted under a high pH.

Figure 6:
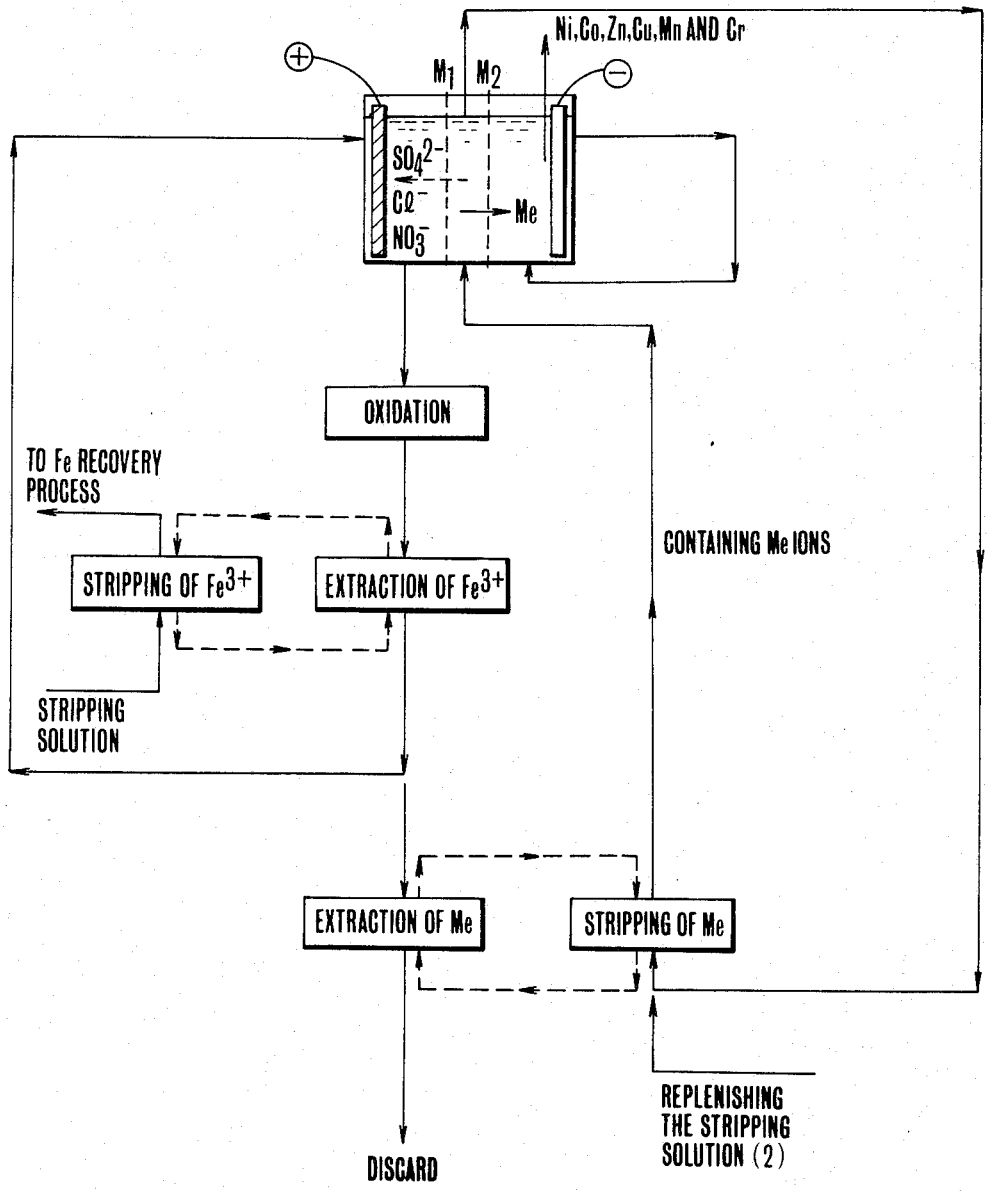
FIG. 6 shows the process in which the stripping solution strips the object metal ions from the extracting solution and supplies the metal to the cathode compartment through the diaphragm.

FIG. 6 shows the case when the stripping solution for the object metal ions is circulated in the intermediate compartment.

Figure 7:
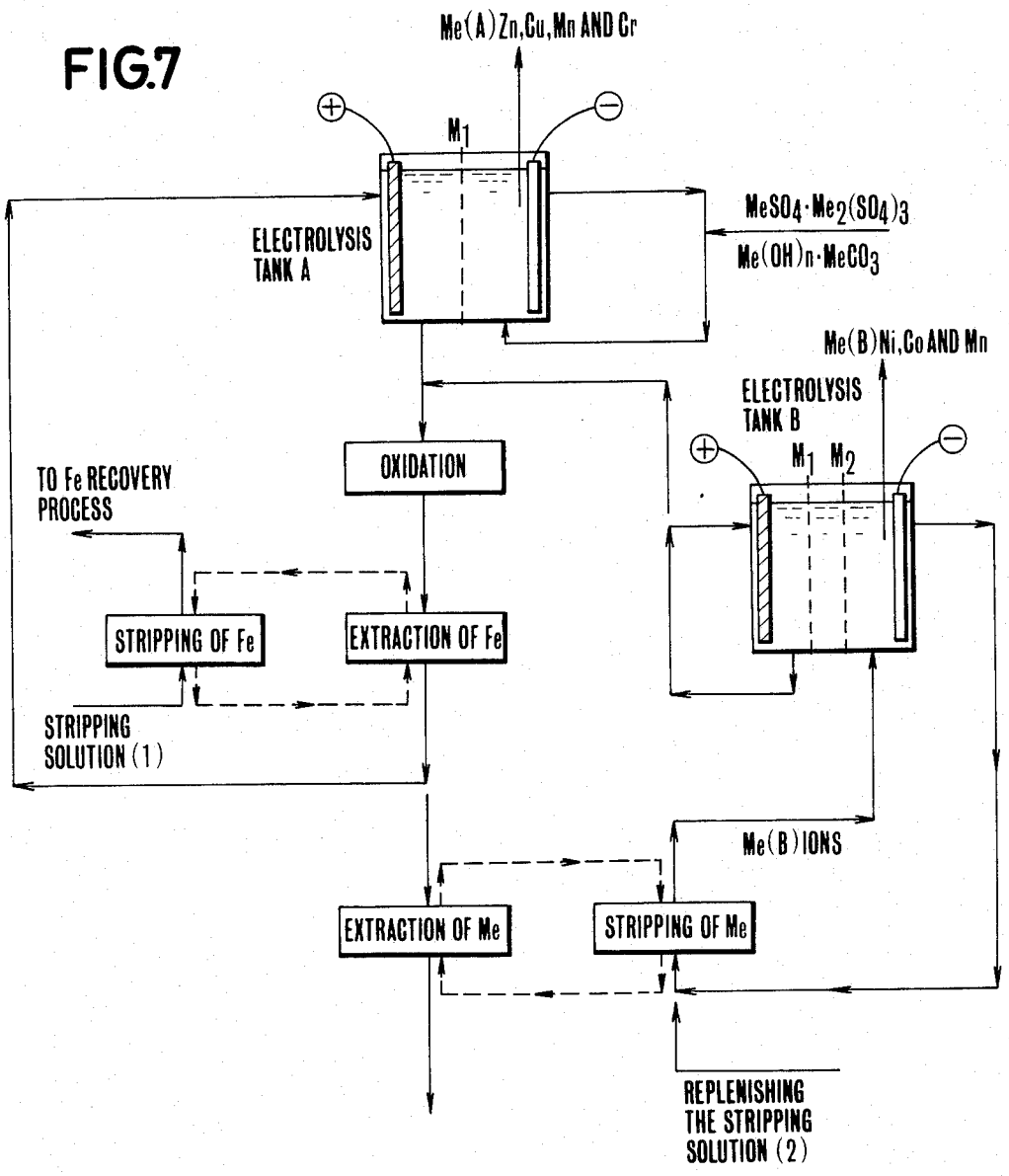
FIGS. 7, 8 and 9 show the electrolytical production of two metals in which the electrical energy necessary for producing metal (A) in the electrolysis tank A can be characteristically reduced to a great extent owing to the dissolution potential of metal (B). Since an alloy of iron with the metal (B) is used for the anode material in this process, the electrolytic production of metal (A) in this combination can be performed with little or rather no addition of external energy.
Figure 8:
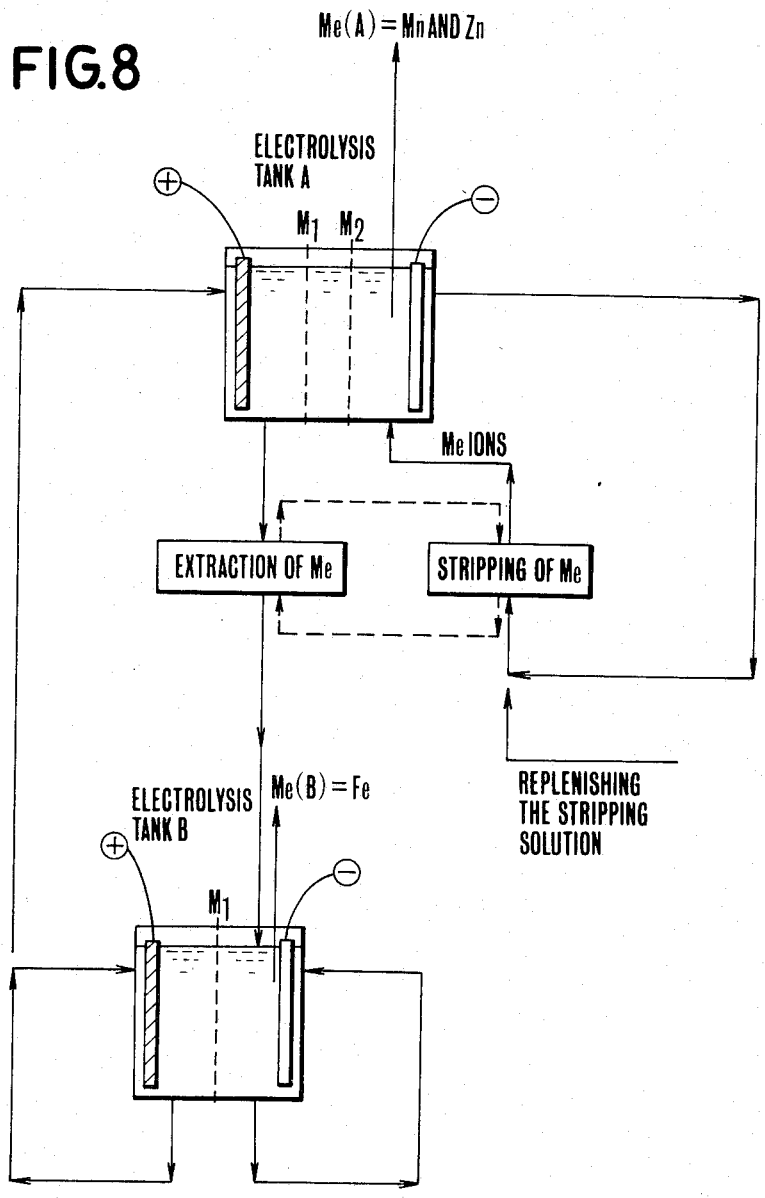
Figure 9:
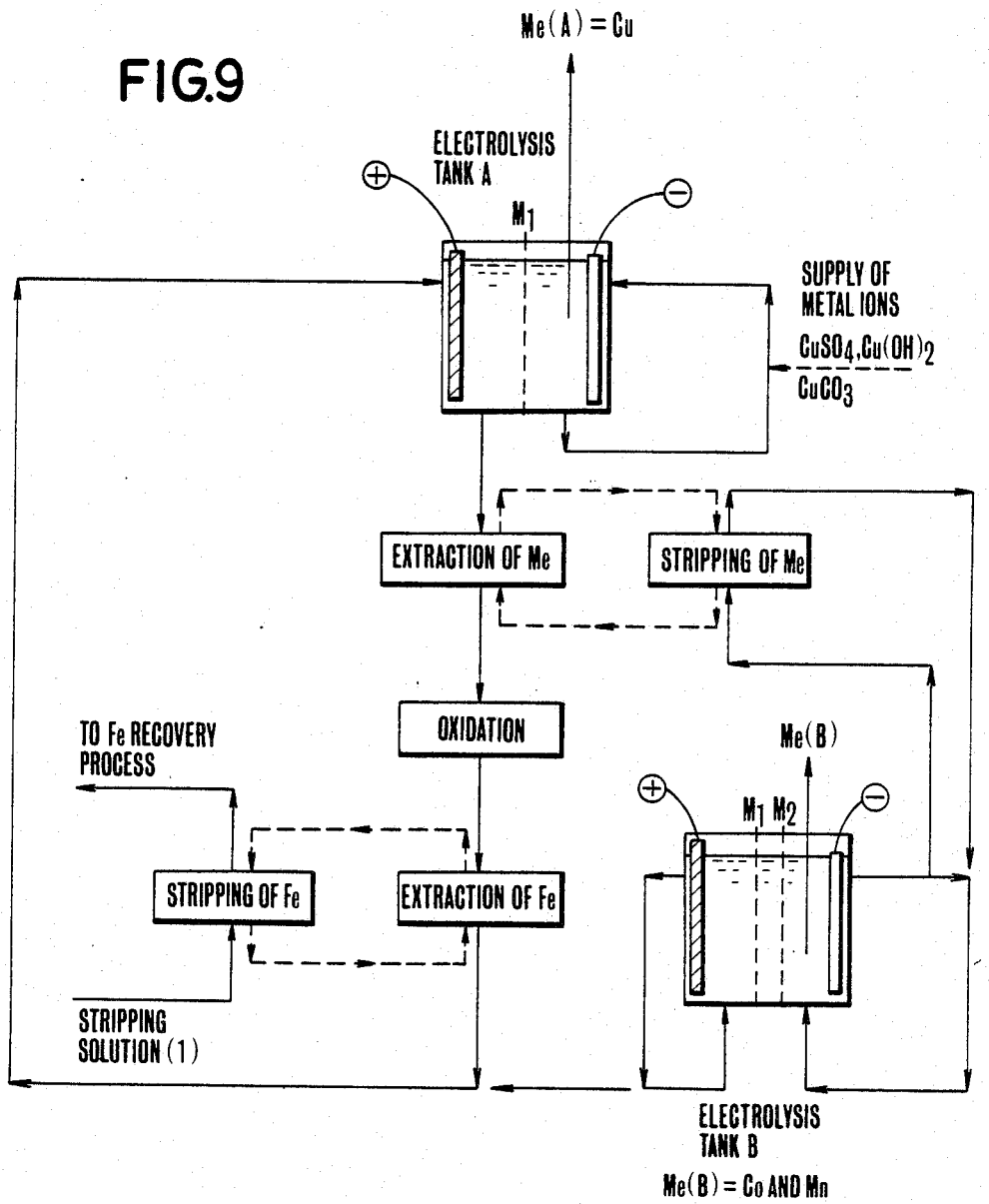

FIGS. 7, 8, 9 are the cases when two or more metals are reduced in a procedure.

In the present invention, resources of the natural origin such as laterite, garnierite and the like can be utilized with ease. In addition, the manganese nodules such as found at the sea bottom can be economically and easily treated. Thus, there will be no limitation of the raw materials in the production of the metals (Ni, Co, Cu, Zn, Mn, and Cr).

In the followings, the present invention will be described and explained in connection with each of the metals.

Use of the Invention in the Electrolytic Smelting of Nickel

Soluble anode to be used for the electrolytic smelting of nickel may include iron alone, ferronickel, ferrocobalt, and ferromanganese. When these metals are used for anode, the anodic potential is lowered to −1.1−−0.2 V. When an insoluble anode is used in contrary, the anodic potential will be about 1.5 V which is the oxygen evolving potential +1.2 V according to Equation 1 plus the oxygen overvoltage that varies depending on the anode material. As apparently seen, the present invention contributes much to reduce the electrolysis voltage. In comparison with the case when a nickel matte is used for the anode, the presence of nickel carbonate for neutralizing $H_2SO_4$ excessively produced by the presence of sulfur contained is unnecessary. Else the electrical energy for adjusting the H+ ion concentration by electrolysis (Japanese Patent Publication No. Sho 34-9251) is not required and the total cost can be reduced. In addition, the dissolved iron ions can be treated to obtain pure iron powder for a commercial product which also contributes to increase the merit of this invention.

The present invention in which a ferronickel anode is employed will be explained in detail with reference to the attached drawings. The circulating solution in the anode compartment is treated for removing the iron content by extraction and a part of the solution is circulated via the intermediate compartment repeatedly to the anode compartment, as shown in FIG. 5, to supply Ni ions to the cathode compartment through the diaphragm between the intermediate and the cathode compartments. Otherwise, a part of the solution from which iron has been removed can be lead directly to the cathode compartment, as shown in FIG. 3, to supply Ni ions to the cathode compartment. As seen in FIG. 4, Ni ions can be extracted by a known process of the solvent extraction (with an organic solvent which is prepared by adding petroleum hydrocarbon for dilution of one or more extracting agents selected from the group consisting of carboxylic acids, alkylaryl phosphoric acids, alkyl phosphoric acids, hydroxyoximes). The organic solvent containing Ni ions by extraction comes into contact with the catholyte, to transfer the Ni ions into the aqueous phase and supply them to the cathode compartment. Also possible is a treatment in which the circulating solution in the intermediate compartment is brought into contact with the Ni containing organic solvent as shown in FIG. 6, to transfer Ni ions to the aqueous phase and supply them from the intermediate compartment to the cathode compartment through the diaphragm between two compartments.

The present invention improves the defect appearing when an insoluble anode is employed and permits the raw materials of a low content of nickel which was so far not suitable for producing nickel matte to be used for the production. Thus, there is found no more limitation as raw materials in the natural resources. Further, such industrial abandoned material as scrapped metallic nickel may be employed as anode. Further, various alloys of iron with metals other than nickel may be prepared. Furthermore, the nickel matte which contains iron, as disclosed in Japanese Patent Publicatioin No. Sho 44-23747, can be employed as material for anode. In the present invention, however, the bath used is not necessarily limited to a chloride bath as in Japanese Patent Publication No. Sho 44-23747, but a mostly sulfuric acid bath suffices so long as the chloride content is sufficient to suppress the anodic passivity. Thus, a large advantage of this invention is removal of limitation in the raw material.

Use of the Invention for Electrolytic Smelting of Cobalt

When an insoluble anode is employed in a sulfuric acid bath, oxygen gas is evolved according to Equation 1 and the potential becomes as high as about 1.5 V (including the oxygen overvoltage). In case of a chloride bath, chlorine gas is evolved according to Equation 2 and the potential reaches about 1.6 V (including the overvoltage). In either case the voltage necessary for the electrolysis is too high. In a chloride bath, in addition, a huge amount of investment is required in treating the chlorine gas evolved (to cause a reaction with $H_2$ and the HCl formed is recovered for repeated use) and this adversely influences the cost in production.

When this invention is applied to the electrolytic smelting of cobalt, various materials can be used for the soluble anode including iron alone, ferronickel (also that of a high cobalt content called "ferronickelcobalt") and those scraps of metal of a high cobalt content which are found in the shaving process of jet and rocket engines. In contrast to the case where an insoluble anode is employed, the anode potential is lowered to −0.4−−0.2 V, which largely lowers the necessary voltage for the electrolysis, hence the cost of production.

The present invention will be explained in more details with reference to the attached drawings. When the circulating solution in the anode compartment is so simple as to contain ions of iron and cobalt, iron ions are removed by extraction and the resulting solution may be partly transferred to the cathode compartment to supply Co ions directly, as shown in FIG. 3. Otherwise, as seen in FIG. 5, the above solution may also be circulated through the intermediate to the anode compartment to supply Co ions through the diaphragm indirectly to the cathode compartment. If the circulating solution contains a variety of metals ions other than iron such as Ni, a part of the circulating solution in the anode compartment from which iron ions have been removed by extraction is brought into contact with an organic solvent which is prepared by adding petroleum hydrocarbon for dilution of one or more extracting agents selected from the group consisting of alkylaryl phosphoric acids, carboxylic acids, alkyl phosphoric acids, hydroxyoximes, alkylamines, ketones, alkylamides, and neutral phosphoric acid esters, to extract $Co^{2+}$ and $CoCl_4^{2-}$ ions, and then the organic solvent is brought into contact with the catholyte to transfer Co ions into the aqueous phase which is then circulated to the cathode compartment to supply Co ions there. The scheme is shown in FIG. 4. Alternatively, as shown in FIG. 6, the organic solvent which contains extracted Co ions comes into contact with the circulating solution in the intermediate compartment to transfer Co ions into the aqueous phase which in turn supply the Co ions to the cathode compartment through the diaphragm existing between the intermediate and the cathode compartments.

A soluble anode is employed in either case, and therefore the anodic potential is in the range −0.4−−0.2 V. The soluble anode keeps the voltage for electrolysis lower and consumes less energy for the electrolysis in comparison with the same process using an insoluble anode. Thus, the invention, when applied to the electrolytic smelting of cobalt, can largely reduce the cost for producing cobalt by nullifying the limitation of raw materials as well as reducing the cost for electrolysis. Since the metallic iron and iron oxide as by-product bring profit, the total cost for producing cobalt is remarkably reduced.

Use of the Invention for the Electrolytic Smelting of Zinc

When an insoluble electrode is employed, oxygen gas is evolved at the anode and the anode potential is as high as about +1.5 V. Considering the cathode potential involving the reaction, $Zn^{2+}+2e^- \rightarrow Zn^0$, the voltage necessary across the electrolysis tank becomes about 3.0 V.

As evidenced by this invention, the anode potential can be successfully lowered to −1.1−−0.2 V by using as material of an insoluble anode iron alone, a mixture of iron with zinc, or a mixture or an alloy of metals mentioned in this invention except zinc (such as Fe, Ni, Co, Cr, and Mn).

The present invention will be explained in more details referring to the attached drawings. To avoid too large a concentration of a dissolved metal other than zinc in the anode compartment, a part or the whole of the circulating solution in the anode compartment is taken out, as shown in FIG. 1, and the iron ions are extracted to suppress the increase of iron ions in the anode compartment. To the cathode compartment, however, $ZnSO_4$, $Zn(OH)_2$, and $ZnCO_3$ are supplied otherwise. Further, when the circulating solution in the anode compartment contains iron and zinc ions, a part or the whole of the circulating solution is oxidized to extract iron ions, and a part or the whole of the resulting solution is brought into contact with an organic solvent which is prepared by adding petroleum hydrocarbon for dilution of one or more extracting agents selected from the group consisting of alkyl phosphoric acids, carboxylic acids, alkylaryl phosphoric acids, hydroxyoximes, to extract zinc ions in the solution. The organic solvent containing the extracted zinc ions is then brought into contact with the catholyte, to extract the zinc ions into the aqueous phase which are transferred to the cathode compartment. Alternatively, as seen in FIG. 6, a part or the whole of the circulating solution in the anode compartment from which iron ions have been removed by extraction is treated to come into contact with an organic solvent which is prepared by adding petroleum hydrocarbon for dilution of one or more extracting agents selected from the group consisting of alkyl phosphoric acids, carboxylic acids, alkylaryl phosphoric acids, hydroxyoximes, alkylamines, ketones, alkylamides, and neutral phosphoric acids esters, to extract Zn and $ZnCl_4^{2-}$ions in the solution, followed by the contact of the organic solvent containing the Zn ion species with the circulating solution in the intermediate compartment, to transfer the Zn and $ZnCl_4^{2-}$ ions into the aqueous phase and to supply the Zn ion species to the cathode compartment. When an alloy not containing zinc such as ferronickel and ferromanganese is employed as material for anode, those material such as $ZnSO_4$, $Zn(OH)_2$, and $ZnCO_3$ which are prepared in a different purification procedure are supplied to the cathode compartment. A part or the whole of the circulating solution in the anode compartment is oxidized to convert iron ions into $Fe^{3+}$ which is then extracted and removed, and the resulting solution is circulated to the anode compartment. The solution from which iron ions have been removed by extraction may contain, depending on the nature of the anode material, Ni and Mn ions. In such a case, the solution is brought into contact with an organic solvent which is prepared by adding petroleum hydrocarbon for dilution of one or more extracting agents selected from the group consisting of alkyl phosphoric acids, carboxylic acids, alkylaryl phosphoric acids, hydroxyoximes, to extract ions of Mn and Ni which are recovered in the following stage not so as to increase the cost for the electrolytic production of zinc. The cost for smelting zinc rather diminishes because the cost for producing the anode from the materials including iron, nickel, cobalt, and manganese is more reduced.

Use of the Invention for the Electrolytic Smelting of Copper

When the present invention is applied to the electrolytic production of copper, the potential of the anode may be lower than that of the cathode (+0.277 V) at which potential copper is deposited. In an extreme case when ferromanganese is employed as anode, the anode potential reaches 31 1.1--0.4 V, which requires little or no energy for the electrolysis for obtaining copper.

The present invention will be explained in more details referring to the attached drawings. A soluble anode prepared from iron alone, a mixture of iron and copper, or a mixture or an alloy of metals other than copper mentioned in this invention such as Fe, Ni, Co, Zn, and Mn is used, being placed in the anode compartment. A part or the whole of the circulating solution in the anode compartment is taken out of the tank and treated for control to suppress the increase of the iron ion concentration as shown in FIG. 1, so as at the same time to suppress the concentration of metal ions dissolved other than copper at a resonable level. To the cathode compartment is supplied Cu in the form of $CuSO_4$ and $Cu(OH)_2$ in a separate procedure. In a simple case when the circulating solution in the anode compartment contains ions of iron and copper only, the solution from which iron ions have been removed by extraction is returned to the anode compartment, but a fraction of the solution is introduced into the cathode compartment to supply Cu ions there as shown in FIG. 3. In other embodiment, the solution may be returned via the intermediate compartment, as seen in FIG. 5. Further as shown in FIG. 4, a part or the whole of the solution from which iron has been removed is brought into contact with an organic solvent which is prepared by adding petroleum hydrocarbon for dilution of one or more extracting agents selected from the group consisting of alkyl phosphoric acids, alkylaryl phosphoric acids, carboxylic acids, and hydroxyoximes, to extract the copper ions in the aqueous solution. In the next place, the organic solvent containing the extracted copper ions is brought into contact with the catholyte, to transfer the copper ions into the aqueous phase in order to supply copper ions to the cathode compartment. As an alternative method as shown in FIG. 6, the organic solvent which contains the extracted copper ions may come into contact with the circulating solution in the intermediate compartment, to transfer the copper ions in the aqueous phase and as a result to supply copper ions to the cathode compartment via the diaphragm between the intermediate and cathode compartments. Furthermore, if a material not containing copper such as ferronickel and ferromanganese which keeps the anode at a very low potential is used for anode, deposition of copper on the cathode can be achieved with little or no application of electrical energy from outside. In such a case, $CuSO_4$, $Cu(OH)_2$, and $CuCO_3$ prepared and purified in a different procedure as shown in FIG. 7 is supplied to the cathode compartment, while a part or the whole of the circulating solution in the anode compartment is taken out and iron ions in it are oxidized into $Fe^{3+}$ which is extracted from the solution and the resulting solution is circulated to the anode compartment. Since the exhaust anolyte from which iron ions have been removed by extraction may contain Mn ions depending on the nature of the anode material, it is brought into contact with an organic solvent which is prepared by adding petroleum hydrocarbon for dilution of one or more extracting agents selected from the group consisting of alkyl phosphoric acids, alkylaryl phosphoric acids, and carboxylic acids, to extract the Mn ions. Subsequently, the organic solvent containing the extracted Mn ions comes into contact with the catholyte, to result in transferring the Mn ions to the aqueous phase and supplying them to the electrolysis tank of Mn. This process not only reduces the cost for the electrolysis of copper, but also adds the profit of producing iron and nickel when the anode is composed of iron, manganese and ferronickel, leading to decrease in the cost of smelting copper.

Use of the Invention for the Electrolytic Smelting of Manganese

When the present invention is utilized, the soluble anode to be used for the electrolytic smelting of manganese is prepared from iron alone or ferromanganese. In previous processes where an insoluble anode is employed, the anode potential reaches to the potential about 1.1 V at which oxygen is evolved according to Equation 1 (more precisely the oxygen evolving potential at pH 8 plus the oxygen overvoltage). In contrast, when the soluble anode is prepared from ferromanganese, the anode potential becomes about −1.1−−0.4 V and a remarkable decrease of the electrolysis voltage is accomplished. If an insoluble anode is employed, an oxidation reaction, $Mn^{2+} \rightarrow Mn^{4+}$ occurs as a side reaction in the anode compartment which reduces the current efficiency, but a soluble anode can successfully suppress the side reaction.

The present invention will be explained in detail referring to the attached drawings. FIGS. 1–3 show the case when the anode is composed of iron alone, while in FIG. 4 ferromanganese is used for the material of anode and ions of iron and manganese (and other impurity metals if ever_exist) are contained in the circulating solution in the anode compartment of which a part or the whole is taken out and treated for oxidation and then the iron ions are removed by extraction to suppress the increase of iron ions in the anode compartment. A part of the solution from which iron ions have been separated by extraction is taken out and brought into contact with an organic solvent which is prepared by adding petroleum hydrocarbon for dilution of one or more extracting agents selected from the group consisting of carboxylic acids, alkyl phosphoric acids, and alkylaryl phosphoric acids, to extract manganese ions in the solution. Subsequently, the organic solvent containing manganese ions comes into contact with the catholyte, to transfer the Mn ions to the aqueous phase and supply them to the cathode compartment. Otherwise, the organic solvent containing Mn ions are brought into contact with the circulating solution in the intermediate compartment to transfer the Mn ions to the aqueous phase and supply them to the cathode compartment through the diaphragm between the intermediate and cathode compartments, as shown in FIG. 6. Further, when ferromanganese is used for the material of anode, a part of the circulating solution in the anode compartment is taken out as shown in FIG. 8 and as is disclosed already in Japanese Patent No. 127985 by the present inventors, it is brought into contact with an organic solvent which is prepared by adding petroleum hydrocarbon for dilution of one or more extracting agents selected from the group consisting of hydroxyoximes, alkyl phosphoric acids, and phosphoric acid esters, to extract manganese ions selectively from the solution, and then the organic solvent containing the extracted manganese ions comes into contact with the catholyte to transfer the Mn ions to the aqueous phase and to regenerate the organic solvent. The solution from which manganese ions have been stripped is circulated to the cathode compartment. The solution from which manganese ions have been removed by extraction is of a high pH value and contains iron ions in the form of $Fe^{2+}$, and therefore the solution is supplied to a cathode compartment of an electrolysis tank for iron to recover the $Fe^{2+}$ ions as metallic iron.

Use of the Invention for the Electrolytic Smelting of Chromium

In previous processes where an insoluble anode is employed, oxygen is evolved at the surface of the anode according to Equation 1 and the anode potential of about 1.5 V is attained. If a soluble anode is employed according to the present invention, the anode potential becomes −0.4 V when iron alone is used for the material of anode. Besides iron alone, ferronickel, ferromanganese and ferrochromium may be used for the material. When any of the metals is used, the anode potential −1.1− −0.2 V is attained, realizing a large decrease of the electrolysis voltage. When an insoluble anode is employed instead, a side reaction, $Cr^{3+} \rightarrow Cr^{6+}$, occurs in the anode compartment which not only lowers the current efficiency but also elevates the voltage necessary for the electrolysis, thus leading to increase in the cost of electrolysis as well as in the electrical energy. In contrast to this, use of a soluble anode permits the elevation of the electrolysis voltage and the oxidation reaction to be suppressed successfully.

The present invention will be explained in details referring to the attached drawings. When iron alone is used as material for the anode, the iron ions increasing in the circulating solution in the anode compartment are removed by extraction as shown in FIGS. 1–3, and therefore the effect is suppressed and not extended to the cathode compartment. FIG. 3 shows the use of an alloy of iron and chromium such as ferrochromium. The iron ions increased in the anode compartment are removed in the process of solvent extraction and the resulting solution containing trivalent chromium is supplied to the cathode compartment. FIG. 5 explains the process in which the $Cr^{3+}$ ions are supplied to the cathode compartment via the intermediate compartment through the diaphragm placed therebetween. The anode potential in FIGS. 3 and 5 becomes −0.4− −0.7 V, though varies with the iron content. FIG. 4 is the case when the soluble anode is prepared from a mixture or an alloy of metals containing nickel or cobalt besides iron and chromium (for example scraps in processing of jet engines) and the anode potential is as low as −0.2−−0.7 V. Considering the potential at which metallic Cr is deposited on a cathode being −0.8 V (the standard potential plus the hydrogen overvoltage), a smaller amount of electrical energy is consumed for the electrolysis, though dependent on the distance between both electrodes and the diaphragm selected. The circulating solution in the anode compartment is taken out and transferred to the iron extraction treatment mentioned above to extract and remove iron ions. The solution after the iron removal is mostly circulated to the anode compartment, while a part of it is taken out and brought into contact with an organic solvent which is prepared by adding petroleum hydrocarbon for dilution of one or more extracting agents selected from the group consisting of carboxylic acids, hydroxyoximes, and phosphoric acid esters, to extract $Cr^{3+}$ ions in the solution. Then the organic solvent containing the $Cr^{3+}$ comes into contact with the circulating solution in the cathode compartment to transfer the $Cr^{3+}$ ions into the aqueous solution and supply them to the cathode compartment. In FIG. 6 where the same procedure is assumed as in FIG. 4, the circulating solution in the intermediate compartment is used for the stripping solution for $Cr^{3+}$ in the organic solvent and the $Cr^{3+}$ ions are supplied to the cathode compartment through the diaphragm. In FIG. 7, the anode is prepared from a mixture or an alloy of metals not containing chromium and a salt of chromium such as $Cr_2(SO_4)_3$ and $Cr(OH)_3$ is prepared and purified separately and supplied to the cathode compartment. If the anode is prepared from a material such as ferromanganese which establishes an anode potential being in the range −1.1– −0.4 V, the potential between the two electrode is 0.1– −0.4 V and therefore the electrical energy required becomes much smaller than when an insoluble anode is employed. In this method, the resultant chromium is accompanied by a by-product metal depending on the anode material used. When the anode material is ferromanganese or ferronickel, the accompanying by-product is electrolytic manganese or nickel, respectively, where the amount of by-product depends on the iron content of the anode material. In either case, the electrical energy needed for the electrolysis can be remarkably reduced in the process of this invention than otherwise.

Some modes of execution of the present invention have been demonstrated above, but this invention is not restricted within them.

The anode material to be used in this invention is selected from the followings:

(a) Iron alone. Usually from a steel plate, steel material and their abandoned matter in the form of a plate, a lump (or a granule) or a string (or a bar).

(b) A plate, granule, lump, and string (or bar) of an alloy of iron and the object metal such as ferrochromium, ferromanganese, ferronickel, and ferrocobalt.

(c) A mixture of iron with an object metal or a mixture of iron with an alloy containing the object metal.

(d) A dross, slug and sulfide containing iron.

The alkyl phosphoric acids to be employed in the present invention are selected from the following members:

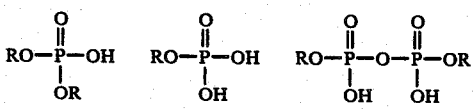

(a) (b) (c)

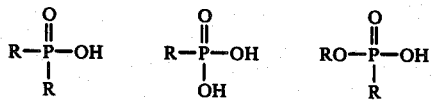

(d) (e) (f)

(where R is an alkyl group which generally contains 4–14 carbon atoms.) $D_2EHPA$ (di-2-ethylhexylphosphoric acid) described in the following Examples belongs to the group (a) in which the alkyl group, R, is $C_8H_{17}$.

Carboxylic acids to be employed in this invention as extracting agent are selected from the following members:

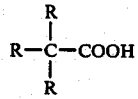

(a)

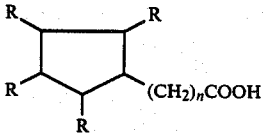

(b)

(In the formulae, R denotes an alkyl group which is usually contains 4–22 carbon atoms.) The V-10 (Versatic-10, trade name, supplied from Shell Chemicals Co. Ltd.) belongs to the group (a) and the alkyl group, R, contains 9–15 carbon atoms.

An example of the oximes employed in this invention as an extracting agent is shown below:

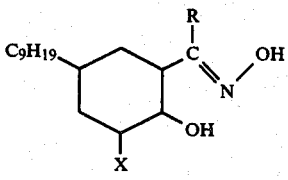

(In the formula, R is

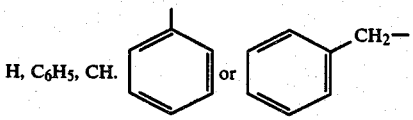

and X is Cl or H.) Oximes similar to above may be used of course, and a mixture of more than two hydroxyoximes such as Lix641N′ (trade name, supplied by Henkel Chemical Co. Ltd.) may be used as well. SME-529 which appears below in Examples is a trade name of what is supplied from Shell Chemical Co. Ltd. in which R is $CH_2$ and X is H.

The alkylaryl phosphoric acids to be employed in this invention are selected from the group expressed by the general formula below:

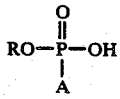

(In the formula, R is an alkyl group generally containing 4–22 carbon atoms and A is generally an aryl group.) In OPPA (octylphenylphosphoric acid) appearing in Examples below, R in the formula is $C_8H_{17}$ and A is $C_6H_5$.

The ketones employed in the present invention are selected from the following group:

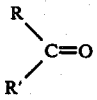

(In the formula, R or R′ is an alkyl group or an aryl group having often 3–15 carbon atoms.) An example of ketones employed in Examples below is as follows:

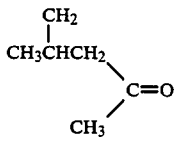

The neutral phosphoric acid esters to be employed in the present invention are selected from the following members:

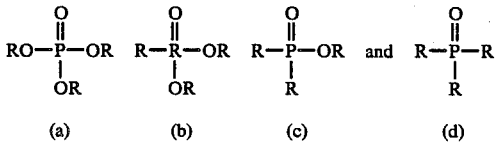

(In the above formulae, R is an alkyl group containing 4–22 carbon atoms). TBP (tributylphosphate) employed in Examples belongs to the group (a) above where R is $C_4H_9$.

The primary—quaternary amines to be employed in the present invention are selected from the following (a) Primary amines, $RNH_2$ (In the formula, R is an alkyl group having 4–25 carbon atoms).

(b) Secondary amines, $R_2N$— or $R_2NH$ (In the formulae, R is an alkyl group having 4–25 carbon atoms).

(c) Tertiary amines, $R_3N$ or $R_3NH$—

(In the formulae, R is an alkyl group having 4–22 carbon atoms).

TOA (trioctylamine) employed in Examples below is expressed by the following formula:

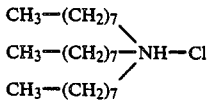

(where Cl in the formula may be replaced by another anion).

(d) Quaternary amines,

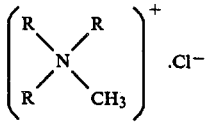

(In the formula, R is an alkyl group having 4–25 carbon atoms and $Cl^-$ may be replaced by another anion).

The amides to be used in this invention are selected from the following groups:

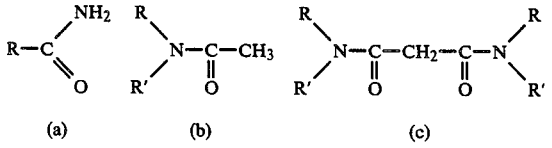

(In the formulae, R is an alkyl group having 4–25 carbon atoms).

The alkylamides employed in Examples belong to group (b) where R is $C_8H_{17}$.

As diluent, both aliphatic and aromatic petroleum hydrocarbons may be employed in this invention. Of course, a mixture of more than two of them serves satisfactorily. Even kerosine, a complex mixture of hydrocarbons, may be used.

Extracting agents are selected from a variety of groups. They may be used alone or as a mixture of two or more. The selection of the extracting agents, with regard to their nature and the method of mixing, is determined by considering the characteristics of the object aqueous solution, nature of impurities, and the proportions thereof. Concentration of an extracting agent may be determined in a similar manner, but it is generally adjusted to 2–100% by volume.

The diaphragms to be employed in this invention may include tissues of natural and synthetic fibers, polyethylene, cellulose acetate, vinyl chloride, polyesters, vinylon, nylon, and Teflon, together with unwoven tissues and sheets of the same materials, ceramics, and anion and cation exchange membranes. The diaphragms used in Examples below named "Selemion" (trade name, supplied by Asahi Glass Co. Ltd.) and "Naphion" (trade name, supplied by Du Pont du Nemours Co.) are cation and anion exchange membranes of the stilben and the Teflon series, respectively. Ion exchange membranes are available from some makers (by the name of Ashiplex from Asahi Chemical Co. Ltd. and Neoseptor from Tokuyama Soda Co. Ltd. and MC and MA from Ionac Co.), and all the ion selective membranes suitable to the object of this invention (the object to prohibit cations or anions to go through) can be employed.

Description of the Preferred Embodiments

The present invention will be explained with the aid of Examples cited below.

EXAMPLE 1

Experiment Electrolytic Production of Nickel (1)

The electrolysis tank and the flow sheet shown in FIG. 4 were employed, but the tank contained two anode compartments and one cathode compartment. The circulating solution in the anode compartment was treated to extract iron as it is in the figure. However, extraction and stripping of nickel ions were omitted and supply of nickel was made by adding nickel sulfate to the cathode compartment. Conditions of experiments are described in Table 1.

In comparison with the case when an insoluble anode was employed, a lower voltage 0.6 V for the electrolysis and a higher current efficiency 95.1% were obtained. As a result, electric power consumed was as low as 1/5.

EXAMPLE 2

Experiment of Electrolytic Production of Nickel (2)

The experiment was carried out according to the flow sheet in FIG. 2, using an ordinary round steel bar (ss-34) for the soluble anode with an intermediate compartment placed between the anode and the cathode compartments. Two rooms for each of the anode and the intermediate compartments and a room for the cathode compartment were provided. Crystals of nickel sulfate were used for supplying nickel ions to the cathode compartment. The conditions for the experiment are shown in Table 2. The circulating solution in the anode compartment contained at first 200 g/l of sulfuric acid and 70 g/l of hydrochloric acid which is to extract iron ions increasing in the anode compartment in the form of chloroiron complex.

In comparison with the case when an insoluble anode was employed, the electrolysis voltage was kept at a much lower level, and the appearance of the solution in the intermediate compartment did not change significantly. Concentration of iron in the stripping solution was around 84 g/l, which was so concentrated as to produce electrolytic iron therefrom in the cathode compartment, if an electrolysis stage for iron is included in the procedure.

EXAMPLE 3

Experiment of Electrolytic Production of Nickel (3)

A cut piece of an Inconel plate was used for the anode. The procedure was followed as shown by the flow sheet in FIG. 6 with each two rooms for the anode and the intermediate compartments and a room for the cathode compartment and the diaphragms used were an anion exchange membrane (Selemion AMV manufactured by Asahi Glass Co.) and a cation exchange membrane (MC-3470 manufactured by Ionac Co.). Since the circulating solution in the intermediate compartment was gradually lost, sulfuric acid was added to it to maintain the total sulfuric acid concentration at 200 g/l to strip nickel from the organic solvent. Conditions are shown in Table 3.

The electrolysis voltage is relatively higher than those in the two preceding Examples, but is lower than that in which an insoluble anode is employed. This, together with the higher current efficiency, demonstrates the merit of the present invention.

EXAMPLE 4

Experiment of Electrolytic Production of Cobalt (1)

Using the ordinary steel (ss material) for the soluble anode and a solution containing nickel sulfate placed in the cathode compartment, a experiment was made according to the flow sheet shown in FIG. 1. Conditions of the electrolysis are found in Table 4.

The voltage necessary for the electrolysis was low and the Co deposited on the cathode contained as low a level of iron as 0.01%. Thus, effectiveness of the anion exchange membrane separating both compartment was demonstrated.

EXAMPLE 5

Experiment of Electrolytic Production of Cobalt (2)

Granules of ferronickel which were placed in a cylindrical vessel with holes drilled on the wall were used as anode. The procedure followed is shown in the form of a flow sheet in FIG. 4. The electrolysis tank was provided with an intermediate compartment between the anode and the cathode compartments. Details of the electrolysis are shown in Table 5.

Although the distance between both electrodes became larger and the voltage for the electrolysis higher, their values are less than half of those required when an insoluble anode was employed. This demonstrates effectiveness of the present invention.

EXAMPLE 6

Experiment of Electrolytic Production of Cobalt (3)

Cut scraps called turnings placed in a basket made from titanium were used as anode and the procedure was followed as shown by the flow sheet in FIG. 6. Conditions of the electrolysis are seen in Table 6.

The current efficiency at the cathode was slightly lowered, but both iron and cobalt can be extracted in the form of chloro-complex and therefore pure water may be used for the stripping.

EXAMPLE 7

Experiment of Electrolytic Production of Copper (1)

The flow sheet in FIG. 1 was followed. Scraps of ordinary steel placed in a P.P. basket served as a soluble anode. Conditions of experiment are shown in Table 7. Electrolytic production of copper was performed with very little consumption of electricity relative to the case when an insoluble anode was employed.

EXAMPLE 8

Experiment of Electrolytic Production of Copper (2)

An electrolysis experiment was performed according to the flow sheet in FIG. 2, using ferromanganese for the anode with no consumption of external energy. Conditions of the electrolysis are shown in Table 8. 300 g/l of $H_2SO_4$ was used to progress the dissolution of ferromanganese at the anode.

EXAMPLE 9

Experiment of Electrolytic Production of Zinc (1)

The experiment was carried out according to the flow sheet in FIG. 2, using ordinary steel (ss material) for the anode. Conditions of the electrolysis are shown in Table 9. The voltage necessary for the electrolysis was about one third of that when an insoluble anode was employed.

EXAMPLE 10

Experiment of Electrolytic Production of Zinc (2)

Ferromanganese anode was employed to reduce the voltage for the electrolysis and the flow sheet in FIG. 7 was followed. Conditions of the electrolysis are shown in Table 10. The circulating solution in the anode compartment, from which iron was removed by extraction, was partly taken out of the route and transferred to the Mn extraction operation, to prevent contamination of the solution.

EXAMPLE 11

Experiment of Electrolytic Production of Chromium (1)

The procedure followed the flow sheet in FIG. 2, using an ordinary steel plate for the soluble anode. Conditions of the electrolysis are shown in Table 11.

EXAMPLE 12

Experiment of Electrolytic Production of Chromium (2)

The procedure of treatment followed the flow sheet in FIG. 5, using a ferrochromium material for the soluble anode. The circulating solution in the anode compartment, from which iron ions were removed and $Cr^{3+}$ ions were increased, was introduced to the intermediate compartment, to supply $Cr^{3+}$ ions to the cathode compartment indirectly through the diaphragm and at the same time circulatingly to reuse the acid which was employed to dissolve raw materials. Conditions of the electrolysis are shown in Table 12 which demonstrates a lower voltage for electrolysis relative to that when a soluble anode is employed.

EXAMPLE 13

Experiment of Electrolytic Production of Chromium (3)

The procedure of treatment followed the flow sheet in FIG. 3, using a ferrochromium material for the anode. A part of the circulating solution in the anode compartment was taken out, iron was removed from it by extraction and the remaining solution was introduced to the cathode compartment to supply $Cr^{3+}$ ions. The voltage for the electrolysis was lower than that in the previous processes.

EXAMPLE 14

Experiment of Electrolytic Production of Manganese (1)

An electrolysis experiment was carried out according to the flow sheet in FIG. 2, using an ordinary steel plate as anode. A finely pored polyethylene membrane served as diaphragm to separate the cathode compartment. Conditions of electrolysis are shown in Table 14. The voltage necessary for the electrolysis was decreased to about a half of that when an insoluble anode was employed.

EXAMPLE 15

Experiment of Electrolytic Production of Manganese (2)

Granules of ferromanganese were employed for anode. Two P.P. baskets, each of the dimension 100×150×20 mm, served as anode cases. An anion exchange membrane was applied to cover the baskets. The procedure of the electrolysis followed the flow sheet in FIG. 6. Manganese was extracted from the circulating solution in the anode compartment and stripped with a solution containing sulfuric acid. The latter solution thus containing 150 g/l of $MnSO_4$ was supplied to the cathode compartment. Conditions of the electrolysis are shown in Table 15.

EXAMPLE 16

Experiment of Electrolytic Production of Manganese (3)

An electrolysis experiment according to the flow sheet in FIG. 8 was conducted using a ferromanganese anode. Mn was extracted from the circulating solution in the anode compartment, and $MnSO_4$ was supplied to the cathode compartment, while iron ions were not extracted, but supplied directly to the electrolysis tank for iron. Details of the electrolysis for Mn are shown in Table 16.

Application of the present invention produces various advantages such as lower voltage necessary for the electrolysis, a higher current efficiency, less electric power required as compared with those when an insoluble electrode is employed.

TABLE 1

Experiment of Electrolytic Production of Nickel (1)

| No. | Item | Anode | Cathode |
|---|---|---|---|
| 1 | Electrode | 80% Fe + 20% Ni<br>2 plates, 90 × 150 mm, hanged | Pure nickel plate<br>A plate, 100 × 150 mm, hanged |
| 2 | Diaphragm | Anion exchange membrane (Selemion AMV) | Not used |
| 3 | Electrolyte | 10 g/l Fe + 80 g/l Ni<br>Total $H_2SO_4$ 200 g/l | 250 g/l $NiSO_4$ + 40 g/l $Na_2SO_4$ + 20 g/l $H_3BO_3$ |
| 4 | Amount of electricity and time | 7 A × 24 h = 168 A · hr | Same as left |
| 5 | Dissolution and deposition | Fe = 140 g<br>Ni = 36 g | Ni (>99.9%) 175 g (95.1% current efficiency) |
| 6 | Amount of extracting solution | 14 liters | $NiSO_4.7H_2O$ crystals added |
| 7 | Organic solvent | 30% $D_2EHPA$ + 70% kerosine | Extraction test omitted |
| 8 | Stripping solution | 100 g/l $NH_4HF_2$ + 30 liters solution (O/A = ½) | Same as above |
| 9 | Intermediate compartment | None | Same as left |
| 10 | Circulating solution in intermediate compartment | None | Same as left |
| 11 | Voltage | 0.6 V | Same as left |

TABLE 2

Experiment of Electrolytic Production of Nickel (2)

| No. | Item | Anode | Cathode |
|---|---|---|---|
| 1 | Electrode | Ordinary steel round bar (ss)<br>10 mmϕ × 150 liters, 2 rows of 10 bars for the anode | A single plate of stainless steel (sus-340), 80 × 150 mm, hanged |
| 2 | Diaphragm | Anion exchange membrane (Selemion AMV) | Cation exchange membrane (Selemion CMV) |
| 3 | Electrolyte | Fe = 50 g/l<br>Total $H_2SO_4$ 200 g/l + total HCl 70 g/l | $NiSO_4$ 250 g/l + $Na_2SO_4$ 40 g/l + $H_3BO_3$ 20 g/l |
| 4 | Amount of electricity and time | 7 A × 24 hr = 168 A · hr | Same as left |
| 5 | Dissolution and deposition | 175 g (100% currnet efficiency) | Ni (99.9%) 169 g (92% current efficiency) |

TABLE 2-continued

| No. | Item | Experiment of Electrolytic Production of Nickel (2) Anode | Cathode |
|---|---|---|---|
| 6 | Amount of extracting solution | 3.5 liters | No occurrence of a nickel containing solution |
| 7 | Organic solvent | 15% TBP + 1% TOA + 84% aromatic hydrocarbon | Supply of Ni ion to the cathode in the form of crystals of $NiCl_2.6H_2O$ |
| 8 | Stripping solution | $(NH_4)_2SO_4$ 100 g/l | |
| 9 | Intermediate compartment | Present | |
| 10 | Circulating solution in intermediate compartment | 50 g/l $H_2SO_4$ | — |
| 11 | Voltage | 0.5 V | — |

TABLE 3

| No. | Item | Experiment of Electrolytic Production of Nickel (3) Anode | Cathode |
|---|---|---|---|
| 1 | Electrode | Inconel plates (processed layers) (75% Ni, 8% Fe, 15% Cr), 2 plates, 80 × 150 mm, hanged | A single plate of pure nickel, 90 × 150 mm, hanged |
| 2 | Diaphragm | Anion exchange membrane (Selemion AMV) | Cation exchange membrane (MC-3470) |
| 3 | Electrolyte | $H_2SO_4$ 250 g/l, (Total $H_2SO_4$) (Ni 80 g/l, Fe 8 g/l, Cr 9 g/l) | $NiSO_4$ 300 g/l + $Na_2SO_4$ 20 g/l + NaAc (Na acetate) 10 g/l |
| 4 | Amount of electricity and time | 7 A × 24 hr = 168 A · hr | Same as left |
| 5 | Dissolution and deposition | Ni = 136 g, Fe 14 g, Cr 16 g (99% current efficiency) | Ni (99.9%) 172 g (93% current efficiency) |
| 6 | Amount of extracting solution | 1.7 liters | 1.7 liters |
| 7 | Organic solvent | 20% $D_2EHPA$ + 10% OPPA + 70% kerosine | 30% SME-529 + 10% TBP + 60% kerosine |
| 8 | Stripping solution | Solution containing 200 g/l $NH_4HF_2$ | Solution containing 200 g/l $H_2SO_4$ |
| 9 | Intermediate compartment | Present | |
| 10 | Circulating solution in intermediate compartment | 100 g/l $H_2SO_4$ | — |
| 11 | Voltage | 1.1 V | — |

TABLE 4

| No. | Item | Experiment of Electrolytic Production of Cobalt (1) Anode | Cathode |
|---|---|---|---|
| 1 | Electrode | 2 plates of ordinary steel (ss-34), each 80 × 150 mm, hanged | A single plate of stainless steel, 90 × 150 mm, hanged |
| 2 | Diaphragm | Anion exchange membrane (MA-3475, Ionac Co.) | None |
| 3 | Electrolyte | $H_2SO_4$ 200 g/l, Fe controlled to <5 g/l | $CoSO_4$ 250 g/l + $NH_4Cl$ 20 g/l + $H_3BO_3$ 40 g/l |
| 4 | Amount of electricity and time | 7 A × 24 hr = 168 A · hr | Same as left |
| 5 | Dissolution and deposition | Fe = 176 g (101% current efficiency) | Co (99.9%) 161 g (87.5% current efficiency) |
| 6 | Amount of extracting solution | 35 liters | No occurrence of a cobalt containing solution, and extraction omitted |
| 7 | Organic solvent | 30% $D_2EHPA$ + 70% n-paraffin | $CoSO_4.7H_2O$ crystals to the cathode circulating solution |
| 8 | Stripping solution | Solution containing 100 g/l $NH_4F$ | — |
| 9 | Intermediate compartment | None | — |
| 10 | Circulating solution in intermediate compartment | — | — |
| 11 | Voltage | 0.5 V | — |

TABLE 5

| No. | Item | Experiment of Electrolytic Production of Cobalt (2) Anode | Cathode |
|---|---|---|---|
| 1 | Electrode | Granules of ferronickel (80% Fe + 20% Ni) packed in 2 holed cases of PVC | A single plate of stainless steel, 90 × 150 mm |
| 2 | Diaphragm | Anion exchange membrane (MA-3475) | Cation exchange membrane (MC-3470) |
| 3 | Electrolyte | $H_2SO_4$ 100 g/l + HCl 50 g/l (Fe 10 g/l, Ni 50 g/l) | |

TABLE 5-continued

| No. | Item | Experiment of Electrolytic Production of Cobalt (2) Anode | Cathode |
|---|---|---|---|
| 4 | Amount of electricity and time | 7 A × 24 hr = 168 A · hr | Same as left |
| 5 | Dissolution and deposition | Fe = 142 g + Ni 36 g + Co 0.9 g | Co (99.9%) 168 g |
| 6 | Amount of extracting solution | 14 liters | 14 liters (when Fe is removed, $CoCl_2.6H_2O$ is added to supply Co ions) |
| 7 | Organic solvent | 30% $D_2EHPA$ + 70% n-paraffin | 10% TOA + 90% aromatic hydrocarbon |
| 8 | Stripping solution | Solution containing 150 g/l $NH_4HF_2$ | Pure water |
| 9 | Intermediate compartment | Present | — |
| 10 | Circulating solution in intermediate compartment | 50 g/l $H_2SO_4$ | — |
| 11 | Voltage | 0.9 V | — |

TABLE 6

| No. | Item | Experiment of Electrolytic Production of Cobalt (3) Anode | Cathode |
|---|---|---|---|
| 1 | Electrode | 2 basketfuls of turnings (18% Co, 22% Ni, 29% Fe, 17% Cr, and 1% Mo) | A single plate of stainless steel (sus-316), hanged |
| 2 | Diaphragm | Anion exchange membrane (MA-3475) | Cation exchange membrane (MC-3470) |
| 3 | Electrolyte | HCl 100 g/l + $H_2SO_4$ 100 g/l (6 g/l Co + 8 g/l Ni + 4 g/l Cr + 10 g/l Fe) | 100 g/l $CoCl_2$ + 40 g/l $NH_4Cl$ + 20 g/l NaAc |
| 4 | Amount of electricity and time | 7 A × 24 hr = 168 A · hr | Same as left |
| 5 | Dissolution and deposition | 35 g Co + 42 g Ni + 54 g Fe + 22 g Cr + 0,5 f Mo (Much anode slime) | 163 g Co (99.9%) (87% current efficiency) |
| 6 | Amount of extracting solution | 5 liters | 5 liters |
| 7 | Organic solvent | 15% TBP + 5% amide + 60% kerosine | 20% TOA + 5% MIBK + 80% aromatic hydrocarbon |
| 8 | Stripping solution | Water | Water |
| 9 | Intermediate compartment | Present | — |
| 10 | Circulating solution in intermediate compartment | 50 g/l $H_2SO_4$ | — |
| 11 | Voltage | 0.7 V | — |

TABLE 7

| No. | Item | Experiment of Electrolytic Production of Copper (1) Anode | Cathode |
|---|---|---|---|
| 1 | Electrode | 2 rows of 10 ordinary steel (ss material) bars, 10 mmϕ × 150 mm | A single plate of copper, 90 × 150 mm, hanged |
| 2 | Diaphragm | Anion exchange membrane (Selemion AMV) | — |
| 3 | Electrolyte | 200 g/l $H_2SO_4$ (Fe = 10 g/l) | 150 g/l $CuSO_4$ |
| 4 | Amount of electricity and time | 7 A × 24 hr = 168 A · hr | Same as left |
| 5 | Dissolution and deposition | 175 g | 180 g Cu (99.9%) (90% current efficiency) |
| 6 | Amount of extracting solution | 17.5 liters | Omitted because of no Cu containing solution |
| 7 | Organic solvent | 20% $D_2EHPA$ + 10% V-10 + 70% n-paraffin | $CuSO_4.5H_2O$ crystal was added to the cathode |
| 8 | Stripping solution | Solution containing 100 g/l $NH_4HF_2$ | |
| 9 | Intermediate compartment | None | — |
| 10 | Circulating solution in intermediate compartment | — | — |
| 11 | Voltage | Not more than 0.1 V | — |

TABLE 8

| No. | Item | Experiment of Electrolytic Production of Copper (2) Anode | Cathode |
|---|---|---|---|
| 1 | Electrode | 2 coppers basketfuls of ferromanganese granules (12% Fe + 76% Mn) | A single copper plate, 90 × 150 mm, hanged |
| 2 | Diaphragm | Anion exchange membrane (Selemion AMV) | Cation exchange membrane (Selemion CMV) |
| 3 | Electrolyte | 200 g/l total $H_2SO_4$ (12 g/l Fe + | 150 g/l $CuSO_4$ |

TABLE 8-continued

| No. | Item | Experiment of Electrolytic Production of Copper (2) Anode | Cathode |
|---|---|---|---|
| | | 76 g/l Mn) | |
| 4 | Amount of electricity and time | 7 A × 24 hr = 168 A · hr | Same as left |
| 5 | Dissolution and deposition | 21 g Fe + 135 g Mn | 190 g Cu (99.99%) |
| 6 | Amount of extracting solution | 1 liter | None |
| 7 | Organic solvent | 30% $D_2EHPA$ + 70% isoparaffin | A solution of 150 g/l of $CuSO_4$ was added to the cathode compartment for supplying Cu ions. |
| 8 | Stripping solution | Solution containing 100 g/l $NH_4F$ | |
| 9 | Intermediate compartment | Present | |
| 10 | Circulating solution in intermediate compartment | 25 g/l $H_2SO_4$ | Solution containing 76 g/l Mn, after iron being removed, is transferred to the cathode compartment. |
| 11 | Voltage | Not more than 0.1 V | |

TABLE 9

| No. | Item | Experiment of Electrolytic Production of Zinc (1) Anode | Cathode |
|---|---|---|---|
| 1 | electrode | 2 plates of ordinary steel (ss material), each 80 × 150 mm, hanged | A single aluminum plate, 90 × 150 mm, hanged |
| 2 | Diaphragm | Anion exchange membrane (Selemion AMV) | Cation exchange membrane (Selemion CMV) |
| 3 | Electrolyte | 200 g/l $H_2SO_4$ (Fe < 5 g/l) | 200 g/l $ZnSO_4$ |
| 4 | Amount of electricity and time | 7 A × 24 hr = 168 A · hr | Same as left |
| 5 | Dissolution and deposition | 180 g Fe | 184 g Zn (99.9%) (90% current efficiency) |
| 6 | Amount of extracting solution | 90 liters | Omitted because of no Zn containing solution |
| 7 | Organic solvent | 20% $D_2EHPA$ + 80% kerosine | $ZnSO_4$ 7 $H_2O$ crystal was added to the cathode to supply Zn ions. |
| 8 | Stripping solution | Solution containing 100 g/l $NH_4HF_2$ | |
| 9 | Intermediate compartment | Present | — |
| 10 | Circulating solution in intermediate compartment | 20 g/l $H_2SO_4$ | — |
| 11 | Voltage | 0.9 V | — |

TABLE 10

| No. | Item | Experiment of Electrolytic Production of Zinc (2) Anode | Cathode |
|---|---|---|---|
| 1 | Electrode | 2 P.P. basketfuls of ferromanganese granules (76% Mn + 22% Fe) | A single aluminum plate, 90 × 150 mm, hanged |
| 2 | Diaphragm | Anion exchange membrane (Selemion AMV) | Cation exchange membrane (Selemion CMV) |
| 3 | Electrolyte | 200 g/l $H_2SO_4$ (13 g/l Mn + 4 g/l Fe) | 150 g/l $ZnSO_4$ |
| 4 | Amount of electricity and time | 7 A × 24 hr = 168 A · hr | Same as left |
| 5 | Dissolution and deposition | 131 g Mn + 38 g Fe | 186 g Zn (>99.9%) (91% current efficiency at the cathode) |
| 6 | Amount of extracting solution | 10 liters | 10 liters |
| 7 | Organic solvent | 30% $D_2EHPA$ + 70% n-paraffin | 20% $D_2EHPA$ + 5% SME-529 + 5% TBP + 70% kerosine |
| 8 | Stripping solution | Solution containing 150 g/l $NH_4HF_2$ | 100 g/l $H_2SO_4$ |
| 9 | Intermediate compartment | Present | |
| 10 | Circulating solution in intermediate compartment | 50 g/l $H_2SO_4$ | |
| 11 | Voltage | 0.4 V | Supply of Zn ion to cathode as $ZnSO_4.7H_2O$ |

TABLE 11

| No. | Item | Experiment of Electrolytic Production of Chromium (1) Anode | Cathode |
|---|---|---|---|
| 1 | Electrode | 2 plates of ordinary steel (ss), | A single plate of stainless steel |

TABLE 11-continued

| No. | Item | Experiment of Electrolytic Production of Chromium (1) Anode | Cathode |
|---|---|---|---|
| | | 80 × 150 mm, hanged | (sus-304), 90 × 150 mm, hanged |
| 2 | Diaphragm | Anion exchange membrane (MA-3475) | Cation exchange membrane (MC-3470) |
| 3 | Electrolyte | 200 g/l $H_2SO_4$ + 10 g/l Fe | 200 g/l $Cr_2(SO_4)_3$ + 140 g/l $(NH_4)_2SO_4$ (pH. 2.4) |
| 4 | Amount of electricity and time | 7 A × 24 hr = 168 A · hr | Same as left |
| 5 | Dissolution and deposition | 180 g Fe | 85 g Cr (99%) (78% current efficiency) |
| 6 | Amount of extracting solution | 18 liters | Omitted because of no Cr containing solution |
| 7 | Organic solvent | 30% $D_2EHPA$ + 70% n-paraffin | A cake of $Cr(OH)_3$ dissolved in $H_2SO_4$ was added to cathode compartment to supply $Cr^{3+}$ ions. |
| 8 | Stripping solution | Solution containing 150 g/l $NH_4HF_2$ | — |
| 9 | Intermediate compartment | Present | — |
| 10 | Circulating solution compartment | 20 g/l $H_2SO_4$ | — |
| 11 | Voltage | 1.4 V | — |

TABLE 12

| No. | Item | Experiment of Electrolytic Production of Chromium (2) Anode | Cathode |
|---|---|---|---|
| 1 | Electrode | Ferrochromium granules in a holed P.P. basket (30% Fe, 66% Cr) | A single plate of stainless steel (sus-316), 90 × 150 mm, hanged |
| 2 | Diaphragm | Anion exchange membrane (Selemion SMV) | Cation exchange membrane (Selemion CMV) |
| 3 | Electrolyte | 200 g/l total $H_2SO_4$ + 20 g/l Fe + 30 g/l $Cr^{3+}$ | 250 g/l $Cr_2(SO_4)_3$ + 150 g/l $(NH_4)_2SO_4$ (pH = 2.1) |
| 4 | Amount of electricity and time | 7 A × 24 hr = 168 A · hr | Same as left |
| 5 | Dissolution and deposition | 41 g Fe + 83 g Cr | 81 g Cr (99%) (75% current efficiency) |
| 6 | Amount of extracting solution | 2 liters | The solution with iron removed is circulated to intermediate compartment to supply $Cr_{3+}$ ions to cathode compartment. |
| 7 | Organic solvent | 30% $D_2EHPA$ + 70% n-paraffin | Extraction of $Cr^{3+}$ was omitted. |
| 8 | Stripping solution | Solution containing 100 g/l $NH_4F$ | |
| 9 | Intermediate compartment | Present | |
| 10 | Circulating solution in intermediate compartment | 30 g/l Cr + 200 g/l total $H_2SO_4$ | |
| 11 | Voltage | 1.4 V | |

TABLE 13

| No. | Item | Experiment of Electrolytic Production of Chromium (3) Anode | Cathode |
|---|---|---|---|
| 1 | Electrode | 2 copper basketfuls of ferrochromium granules (30% Fe + 65% Cr) | A single copper plate, 90 × 150 mm, hanged |
| 2 | Diaphragm | Anion exchange membrane (MA-3475) | None |
| 3 | Electrolyte | 200 g/l total $H_2SO_4$ + 10 g/l Fe + 60 g/l $Cr^{3+}$ | 250 g/l $Cr_2(SO_4)_3$ + 150 g/l $(NH_4)_2SO_4$ (pH = 2.1) |
| 4 | Amount of electricity and time | 7 A × 24 hr = 168 A · hr | — |
| 5 | Dissolution and deposition | 40 g Fe + 83 g Cr | 82 g Cr (99%) |
| 6 | Amount of extracting solution | 4 liters | 2 liters |
| 7 | Organic solvent | 30% $D_2EHPA$ + 70% n-paraffin | A half of the Fe removed solution was transferred to the cathode compartment. Extraction of $Cr^{3+}$ ions was omitted. |
| 8 | Stripping solution | Solution containing 100 g/l $NH_4F$ | — |
| 9 | Intermediate compartment | None | — |
| 10 | Circulating solution in intermediate compartment | None | — |
| 11 | Voltage | 1.1 V | |

TABLE 14

| No. | Item | Anode | Cathode |
|---|---|---|---|
| 1 | Electrode | 2 plates of ordinary steel (ss material), 80 × 150 mm, hanged | A single plate of stainless steel (sus-304), 90 × 150 mm, hanged |
| 2 | Diaphragm | Anion exchange membrane (Selemion AMV) | Finely porous polyethylene membrane (Juraguard) (with polyplastic holes) |
| 3 | Electrolyte | 100 g/l $H_2SO_4$ + 20 g/l Fe | 50 g/l $MnSO_4$ + 120 g/l $(NH_4)_2SO_4$ (pH = 8.1) |
| 4 | Amount of electricity | 7 A × 24 hr = 168 A · hr | Same as left |
| 5 | Dissolution and deposition | 178 g Fe | 115 g Mn (99.9%) (67% current efficiency) |
| 6 | Amount of extracting solution | 9 liters | Extraction was omitted because of no Mn containing solution. |
| 7 | Organic solvent | 30% $D_2EHPA$ + 70% kerosine | Separately prepared solution of $MnSO_4$ was added to cathode compartment. |
| 8 | Stripping solution | Solution containing 150 g/l $NH_4F$ | — |
| 9 | Intermediate compartment | Present | — |
| 10 | Circulating solution in intermediate compartment | 10 g/l $H_2SO_4$ | — |
| 11 | Voltage | 2.4 V | — |

TABLE 15

Experiment of Electrolytic Production of Manganese (2)

| No. | Item | Anode | Cathode |
|---|---|---|---|
| 1 | Electrode | Granules of ferromanganese (12% Fe + 76% Mn) in two P.P. baskets with membrane cover, hanged | A single plate of stainless steel (sus-304), 90 × 150 mm, hanged |
| 2 | Diaphragm | Anion exchange membrane (MA-3475) | Cation exchange membrane (MC-3470) |
| 3 | Electrolyte | 150 g/l total $H_2SO_4$ (10.5 g/l Fe + 66 g/l Mn) | 50 g/l $MnSO_4$ + 150 g/l $(NH_4)_2SO_4$ (pH = 8.2) |
| 4 | Amount of electricity and time | 7 A × 24 hr = 168 A · hr | Same as left |
| 5 | Dissolution and deposition | 21 g Fe + 132 g Mn | 128 g Mn (99.9%) (74% current efficiency) |
| 6 | Amount of extracting solution | 2 liters | 2 liters |
| 7 | Organic solvent | 20% $D_2EHPA$ + 10% OPPA + 70% n-paraffin | 25% $D_2EHPA$ + 5% TBP + 5% SME-529 + 65% n-paraffin |
| 8 | Stripping solution | Solution containing 100 g/l $NH_4F$ | 100 g/l $H_2SO_4$ |
| 9 | Intermediate compartment | Present | (Stripping solution was placed in cathode compartment.) |
| 10 | Circulating solution in intermediate compartment | 20 g/l $H_2SO_4$ | — |
| 11 | Voltage | 1.8 V | — |

TABLE 16

| No. | Item | Anode | Cathode |
|---|---|---|---|
| 1 | Electrode | Granules of ferromanganese (12% Fe + 76% Mn) in two P.P. baskets | A single plate of stainless steel (sus-304), 90 × 150 mm, hanged |
| 2 | Diaphragm | Anion exchange membrane (Selemion AMV) | Cation exchange membrane (MC-3470) |
| 3 | Electrolyte | 100 g/l total $H_2SO_4$ (11 g/l Fe + 76 g/l Mn) | 40 g/l $MnSO_4$ + 120 g/l $(NH_4)_2SO_4$ (pH = 8.1) |
| 4 | Amount of electricity and time | 7 A × 24 hr = 168 A · hr | Same as left |
| 5 | Dissolution and deposition | 22 g Fe + 152 g Mn (110% current efficiency) | 120 g Mn (99.9%) (71% current efficiency) |
| 6 | Amount of extracting solution | Fe not extracted, but introduced into the cathode of Fe electrolysis tank | 2 liters |
| 7 | Organic solvent | (Omitted) | 20% $D_2EHPA$ + 5% TBP + 5% V-10 + 70% kerosine (extraction of $Mn^{2+}$) |
| 8 | Stripping solution | None | 100 g/l $H_2SO_4$ |
| 9 | Intermediate compartment | Present | (Stripping solution was aded to cathode compartment of Mn electrolysis tank) |
| 10 | Circulating solution in intermediate compartment | 10 g/l $H_2SO_4$ | |
| 11 | Voltage | 2.1 V | |

What is claimed is:

1. Process for electrolytically producing metals of Ni, Co, Zn, Cu, Mn, and Cr, comprising:

electrolyzing an aqueous solution of an acid selected from the group consisting of sulfuric acid, hydrochloric acid and nitric acid and containing ions of a metal as a main component selected from Ni, Co, Zn, Cu, Mn, and Cr in a cathode compartment to deposit the metal electrolytically on a cathode, the cathode compartment being separated by one or more diaphragms from the remainder of the solution where iron or a metal containing iron is used for the material of a corrosible anode, and maintaining the concentration of iron ion in the solution circulating in the anode compartment at a low level by bringing the whole or a part of the circulating solution into contact with an organic solvent which is prepared by adding petroleum hydrocarbon for dilution of one or more extracting agents selected from the group consisting of carboxylic acids, alkylaryl phosphoric acids, hydroxyoximes, alkyl phosphoric acids, alkylamines, ketones, alkylamides, and neutral phosphoric acid esters, to extract and remove the iron.

2. The process according to claim 1, wherein the concentration of iron ion in the solution circulating to the anode compartment is maintained at a low level by oxidizing all or a part of the circulating solution, and bringing the oxidized solution into contact with an organic solvent which is prepared by adding peteroleum hydrocarbon for dilution of one or more extracting agents selected from the group consisting of carboxylic acids, alkylaryl phosphoric acids, alkylamines, ketones, alkylamides, and neutral phosphoric acid esters, to extract and remove the iron.

3. Process for electrolytically producing metals of Ni, Co, Zn, Cu, Mn, and Cr, comprising:

electrolyzing an aqueous solution containing ions of a metal as main component selected from Ni, Co, Zn, Cu, Mn, and Cr in the cathode compartment to deposit the metal electrolytically on the cathode, the cathode compartment being separated by one or more diaphragms from the remainder of the solution where iron or a metal containing iron is used for material of corrosible anode.

bringing the whole or a part of the solution circulating to the anode compartment into contact with an organic solvent which is prepared by adding petroleum hydrocarbon for dilution of one or more extracting agents selected from the group consisting of carboxylic acids, alkylaryl phosphoric acids, hydroxyoximes, alkyl phosphoric acids, alkylamines, ketones, alkylamides, and neutral phosphoric acid esters, to extract and remove the iron, adjusting the hydrogen ion concentration of the whole or a part of the circulating solution, bringing the same solution again into contact with an organic solvent which is prepared by adding petroleum hydrocarbon for dilution of one or more extracting agents selected from the group consisting of carboxylic acids, alklaryl phosphoric acids, hydroxyoximes, alkyl phosphoric acids, alkylamines, ketones, alkylamides, and neutral phosphoric acid esters, to extract ions of at least one metal selected from the group consisting of Ni, Co, Zn, Cu, Mn, and Cr from the solution, bringing the organic solvent into contact with a circulating stripping solution containing sulfuric and hydrochloric acids, to transfer the metal ions to the stripping solution, and finally introducing said stripping solution into the cathode compartment.

4. Process for electrolytically producing metals of Ni, Co, Zn, Cu, Mn, and Cr, comprising:

electrolyzing an aqueous solution containing ions of a metal as main component selected from Ni, Co, Z, Cu, Mn, and Cr in the cathode compartment to deposit the metal electrolytically on the cathode, the cathode compartment being separated by two or more diaphragms from the remainder of the solution where iron or a metal containing iron is used as a soluble anode, oxidizing all or a part of the solution circulating to the anode compartment and bring the oxidized solution into contact with an organic solvent which is prepared by adding petroleum hydrocarbon for dilution of one or more extracting agents selected from the group consisting of carboxylic acids, alkylaryl phosphoric acids, hydroxyoximes, alkyl phosphoric acids, alkylamines, ketones, alkylamides, and neutral phosphoric acid esters to extract and remove the iron ions, introducing the solution to the intermediate compartment located between the anode and the cathode compartments, to transfer the cations in the solution into the cathode compartment through the diaphragm, and then introducing the solution into the anode compartment.

5. Process for electrolytically producing metals of Ni, Co, Zn, Cu, Mn, and Cr, comprising:

electrolyzing an aqueous solution containing ions of a metal as main component selected from Ni, Co, Zn, Cu, Mn and Cr in the cathode compartment to deposite the metal electrolytically on the cathode, the cathode compartment being separated by one or more diaphrams from the remainder of the solution where iron or a metal containing iron is used for the material of a corrrosible anode, bringing the whole or a part of the solution ciruclating to the anode compartment into contact with an organic solvent which is prepared by adding petroleum hydrocarbon for dilution of one or more extracting agents selected from the group consisting of carboxylic acids, alkylaryl phosphoric acids, hydroxyoximes, alkyl phosphoric acids, hydroxyoximes, alkyl phosphoric acids, alkylamines, ketones, alkylamides, and neutral phosphoric acid esters, to extract and remove the iron, adjusting the hydrogen ion concentration of the whole of a part of the circulating solution, bringing the same solution again into contact with an organic solvent which is prepared by adding petroleum hydrocarbon for dilution of one or more extracting agents selected from the group consisting of carboxylic acids, alkylaryl phosphoric acids, alkyl phopsphoric acids, alkylamines, ketones, alkylamides, and neutral phosphoric acid esters, to extract ions of at least one metal selected from the group consisting of Ni, Co, Zn, Cu, Mn and Cr from the solution, bringing the organic solvent into contact with a circulating stripping solution containing sulfuric and hydrochloric acids, to transfer the metal ions to the stripping solution, and finally introducing said stripping solution into the cathode compartment.

* * * * *